US007172099B2

(12) United States Patent
Höfte et al.

(10) Patent No.: US 7,172,099 B2
(45) Date of Patent: Feb. 6, 2007

(54) FLUID DELIVERY MECHANISM

(75) Inventors: Paulus Antonius Augustinus Höfte, Sint Martens Latern (BE); Gregroy Clegg Spooner, Hong Kong (HK); Terence Graham Curtis, Bucks (GB); Hoss Vong, Hong Kong (HK); Phillip Gene Nagel, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 291 days.

(21) Appl. No.: 10/658,031

(22) Filed: Sep. 9, 2003

(65) Prior Publication Data

US 2005/0254882 A1 Nov. 17, 2005

Related U.S. Application Data

(60) Provisional application No. 60/409,263, filed on Sep. 9, 2002.

(51) Int. Cl.
*B67D 25/40* (2006.01)

(52) U.S. Cl. ..... 222/481.5

(58) Field of Classification Search ..... 222/478, 222/481, 481.5, 481.1; 401/270–276
See application file for complete search history.

(56) References Cited

U.S. PATENT DOCUMENTS

| | | | | |
|---|---|---|---|---|
| 2,337,276 A * | 12/1943 | Sanchis | 141/296 |
| 3,204,832 A * | 9/1965 | Morgan | 222/196 |
| 3,802,606 A | 4/1974 | Gust | |
| 5,655,686 A * | 8/1997 | Jermyn | 222/211 |
| 5,732,853 A | 3/1998 | Ganzeboom et al. | |
| 5,875,921 A | 3/1999 | Osgar et al. | |
| 6,206,058 B1 | 3/2001 | Nagel et al. | |
| 6,386,392 B1 | 5/2002 | Argentieri et al. | |

FOREIGN PATENT DOCUMENTS

| | | |
|---|---|---|
| DE | 11 53 497 B | 8/1963 |
| EP | 1 075 817 A | 2/2001 |
| EP | 1 180 343 A | 2/2002 |
| GB | 555 197 A | 8/1943 |

* cited by examiner

*Primary Examiner*—Huyen Le
(74) *Attorney, Agent, or Firm*—Thibault Fayette; Mark A. Charles; Kim W. Zerby

(57) ABSTRACT

The present invention provides a fluid transfer fitment for controllably retaining a fluid in a reservoir in a leak-tight manner. This fluid transfer fitment can be used with a variety of fluid delivery mechanisms. The fluid transfer fitment has a cap portion, an engaging segment, a fluid transfer check valve and a vent check valve. The fluid transfer check valve of the fitment is located within the engaging segment of the fitment.

The present invention also provides fluid delivery mechanisms, which can be used with a cleaning implement. The fluid delivery mechanisms can be used with a fitment having a cap portion, an engaging segment and a fluid transfer check valve.

1 Claim, 20 Drawing Sheets

FLUID DELIVERY MECHANISM

CROSS REFERENCE TO RELATED APPLICATION

This application claims the benefit of priority to U.S. Provisional Application Ser. No. 60/409,263, filed Sep. 9, 2002, which is herein incorporated by reference.

TECHNICAL FIELD

The present invention relates to a fitment suitable for use with a variety of a fluid delivery mechanism of cleaning implements used to clean hard surfaces.

The present invention also relates to fluid delivery mechanisms suitable for a cleaning implement for cleaning a hard surface.

BACKGROUND OF THE INVENTION

The literature is replete with products capable of cleaning hard surfaces such as ceramic tile floors, hardwood floors, counter tops and the like. In the context of cleaning floors, numerous mopping devices and other cleaning implements are described which comprise a handle attached to a mop head, a fluid delivery mechanism which can be either attached to or incorporated within the handle and a reservoir which can be used to store a cleaning composition and which is in fluid communication with the fluid delivery mechanism. These cleaning implements usually have a handle comprising at least one pole segment attached at one end to a mop head and at the other end to a hand-grip. The hand-grip can include a trigger, a switch or any other type of actuating mechanism suitable for remotely actuating the fluid delivery mechanism. Some cleaning implements comprise a reservoir which is permanently attached to the implement and which can be filled by a user. Examples of such cleaning implements are disclosed in U.S. Pat. No. 2,228,573 to A. L. Lowe, filed Mar. 4, 1938, and U.S. Pat. No. 6,227,744 to Fodrocy et al, filed Oct. 12, 1999, which disclose cleaning implements with a refillable reservoir. Other types of cleaning implements comprise a reservoir which is removably attachable to the fluid delivery mechanism of the cleaning implement. One example of such cleaning implements can be found in International Application serial No PCT/US00/09498 to Hall et al, filed Mar. 23, 2001, and assigned to the Clorox Company, which describe cleaning implements having a liquid reservoir which is removably attachable to a fluid delivery mechanism which can be integrated into a cap and which is removably attachable to the finish of the reservoir. The first end of a tube is attached to this cap and the second end is attached to a nozzle which can be removably attached to the mop head of a cleaning implement. In order to replace an emptied reservoir, a user must remove the nozzle from the mop head, then thread it through the universal joint connecting the mop head to the handle and remove the cap from the emptied bottle. A user can then reattach the cap to a new filled reservoir and then reattach the nozzle to the mop head. Alternatively, when replacing an emptied reservoir, the user can also leave the nozzle attached to the mop head but in this case, the length of the tube can limit the ability of the user to maneuver or manipulate the reservoir while maintaining the cleaning implement stable. In addition, the disclosed fitment including the fluid delivery mechanism is specific in the sense that it is only usable as a gravity fed delivery mechanism and does not allow the user to use the reservoir with another kind of fluid delivery mechanism.

Another example of such a cleaning implement is disclosed in copending U.S. patent application Ser. No. 09/831,480, to Policicchio et al., filed Nov. 9, 1999, and assigned to the Procter & Gamble Company. The reservoir of the described cleaning implements can be removably attached to a fluid delivery mechanism with a mechanism such as the one described in U.S. Pat. No. 6,206,058 to Nagel et al, filed Nov. 9, 1998, and assigned to The Procter & Gamble Company, which discloses a fitment removably attachable to a reservoir and including a venting valve and a fluid transfer check valve.

Another type of mechanism is also disclosed in U.S. Pat. No. 6,386,392, to Lawson et al., filed May 22, 2000, and assigned to The Procter and Gamble Company, which discloses a reservoir comprising a cap having an opening covered with a needle-pierceable membrane. When this bottle is inserted in the housing of a cleaning implement, this membrane can be pierced by a first needle for delivering a liquid and by a second needle for venting this reservoir. As the cap having the needle-pierceable membrane is attached to the reservoir, the user can conveniently handle the reservoir and insert it or remove it from the housing. Nonetheless, this type of reservoir can only be used with a fluid delivery mechanism comprising at least one needle.

While the prior art addresses the problem associated with cleaning implements having a liquid delivery mechanism to deliver a liquid from a reservoir, the fitments which are disclosed are specialized in the sense that they do not provide a fluid transfer fitment usable with a variety of fluid delivery mechanisms which can be conveniently attachable by a user to a reservoir.

As such, there remains a need for such a fitment attachable to a reservoir that offers both convenience, a low manufacturing cost and the ability to be used with a variety of fluid delivery mechanism.

SUMMARY OF THE INVENTION

The present invention relates to a fluid transfer fitment suitable for controllably retaining a liquid in a reservoir in a leak-tight manner and capable of being used with a variety of fluid delivery mechanisms. In one embodiment, the fluid transfer fitment can have a cap portion, an engaging segment, a fluid transfer check valve and a vent check valve. In a preferred embodiment, the fluid transfer check valve can be located within the engaging segment of the fitment.

The present invention also relates to fluid delivery mechanisms, in connection with a cleaning implement and suitable for being used with a fitment having a cap portion, an engaging segment and a fluid transfer check valve.

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

DETAILED DESCRIPTION OF THE INVENTION

Figure 1:
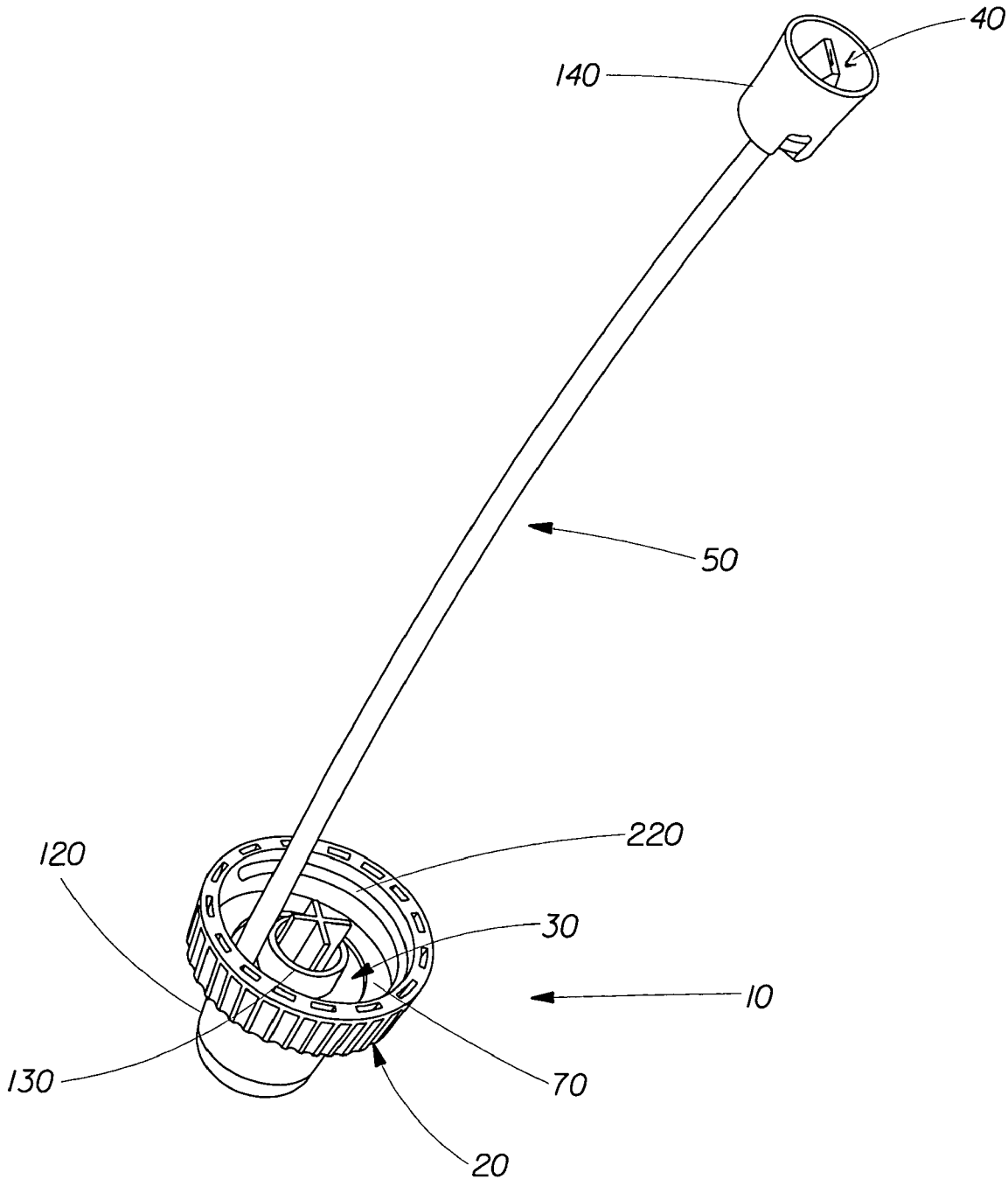
FIG. 1 is an isometric view of a fitment of the present invention.

While not intending to limit the utility of the fluid delivery mechanism herein, it is believed that a brief description of its use in association with a modern mopping implement will help elucidate the invention.

In heretofore conventional wet-mopping operations, the mop user requires a source of detersive liquid for application to the surface being cleaned by means of the mop head. Earlier practice was to dip the mop head into an external source of liquid, such as a bucket, optionally wring-out the excess of liquid, and then apply the mop head to the surface with sufficient force to dislodge soil therefrom. Unfortunately, after repeated usage, the mop heads themselves, become dirty, unsanitary, unsightly and have to be removed and laundered.

Modern mopping implements employ disposable sheets or absorbent pads, which are releasably affixed to the head of the mopping implement, and which can conveniently be discarded and replaced after soiling. Even more modern implements carry their own reservoir of detersive liquid, thereby greatly enhancing their usefulness and convenience. In use, the liquid is dispensed onto the surface being cleaned via a liquid delivery mechanism.

As will be immediately appreciated, it becomes necessary to, somehow, affix the reservoir to such an implement. Moreover, from time-to-time, it is necessary to replenish the detersive liquid in the reservoir. As will be seen from the disclosures herein this affixing-usage-removal-refill-replacement sequence results in several problems whose solutions are non-trivial.

The first problem faced by the manufacturer is that the reservoir is typically inverted and affixed to the implement in an inverted position so that the gravity force contributes to the deliver of the detersive liquid. Inversion of a fluid-containing reservoir can, of course, result in spillage. Moreover, with certain designs, a small amount of liquid can remain in the reservoir and/or in the implement and/or in the various fitments and tubes connecting the whole assembly when the liquid in the reservoir is sufficiently depleted that its refill is judged necessary or that a different type of detersive liquid is desired. Even such small amounts of liquid can cause unacceptable spillage or leakage when the reservoir is removed.

In addition, the coupling of the inverted reservoir to the implement must be simple for users so that an essentially leak-proof joint or connection is achieved. Moreover, various vents, seals, valves, and the like, must be employed to provide good flow of the detersive liquid to the mop head or directly onto the surface being cleaned. Operational means to start-and-stop the liquid flow must be provided. Yet, the overall construction of the implement and its reservoir should be sufficiently simple that it is economical to manufacture and sell. As noted, the overall construction of the reservoir and its interconnecting fluid transfer fitment, is preferably one that would be useful on a variety of implements having different types of fluid delivery mechanism.

The foregoing considerations are addressed by the present invention, as will be clear from the detailed disclosures which follow.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

I. Fluid Transfer Fitment

Referring to FIG. 1, a fluid transfer fitment which is preferably removably attachable to a reservoir is represented.

Figure 2:
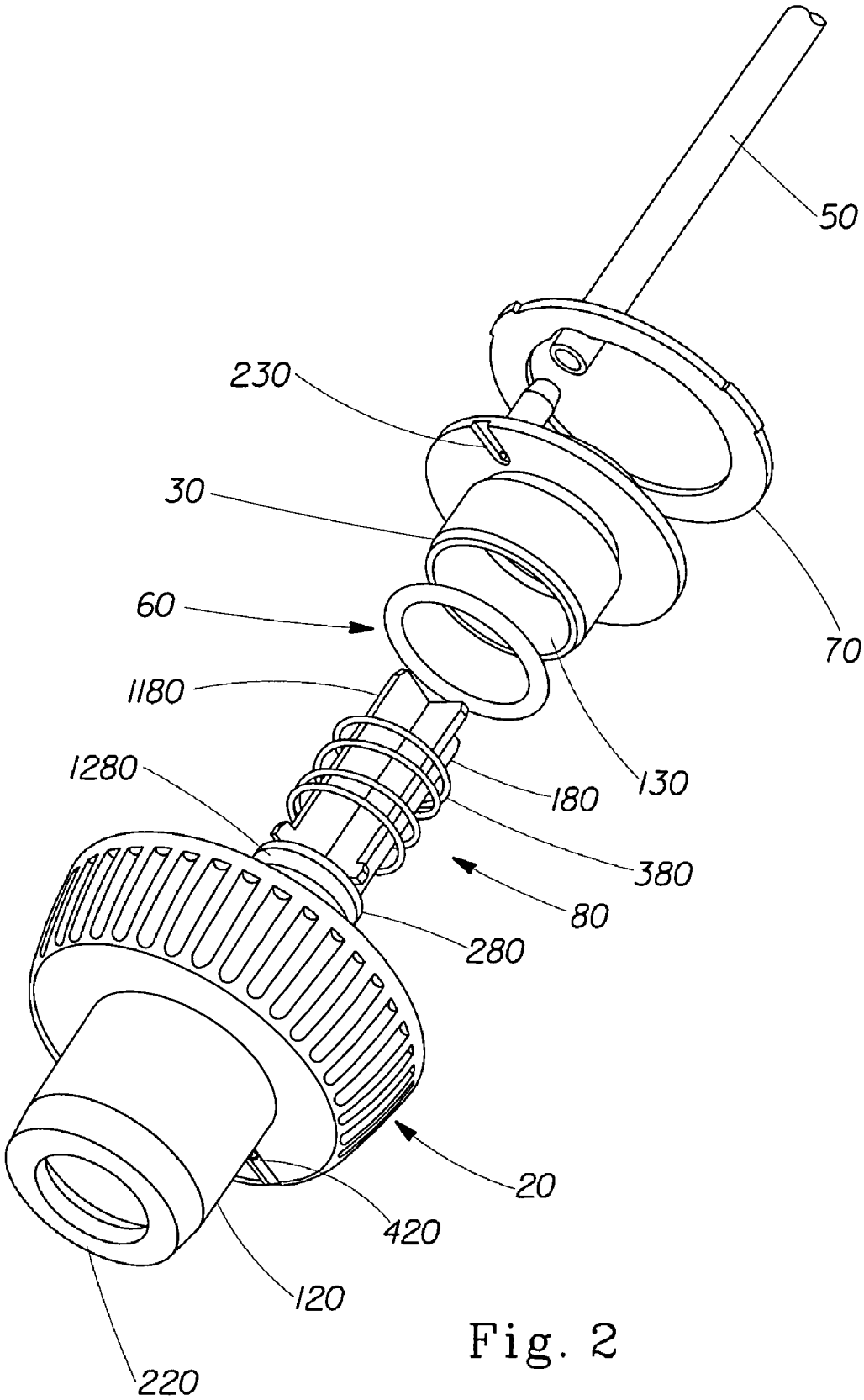
FIG. 2 is an exploded view of the embodiment shown in FIG. 1.
Figure 3:
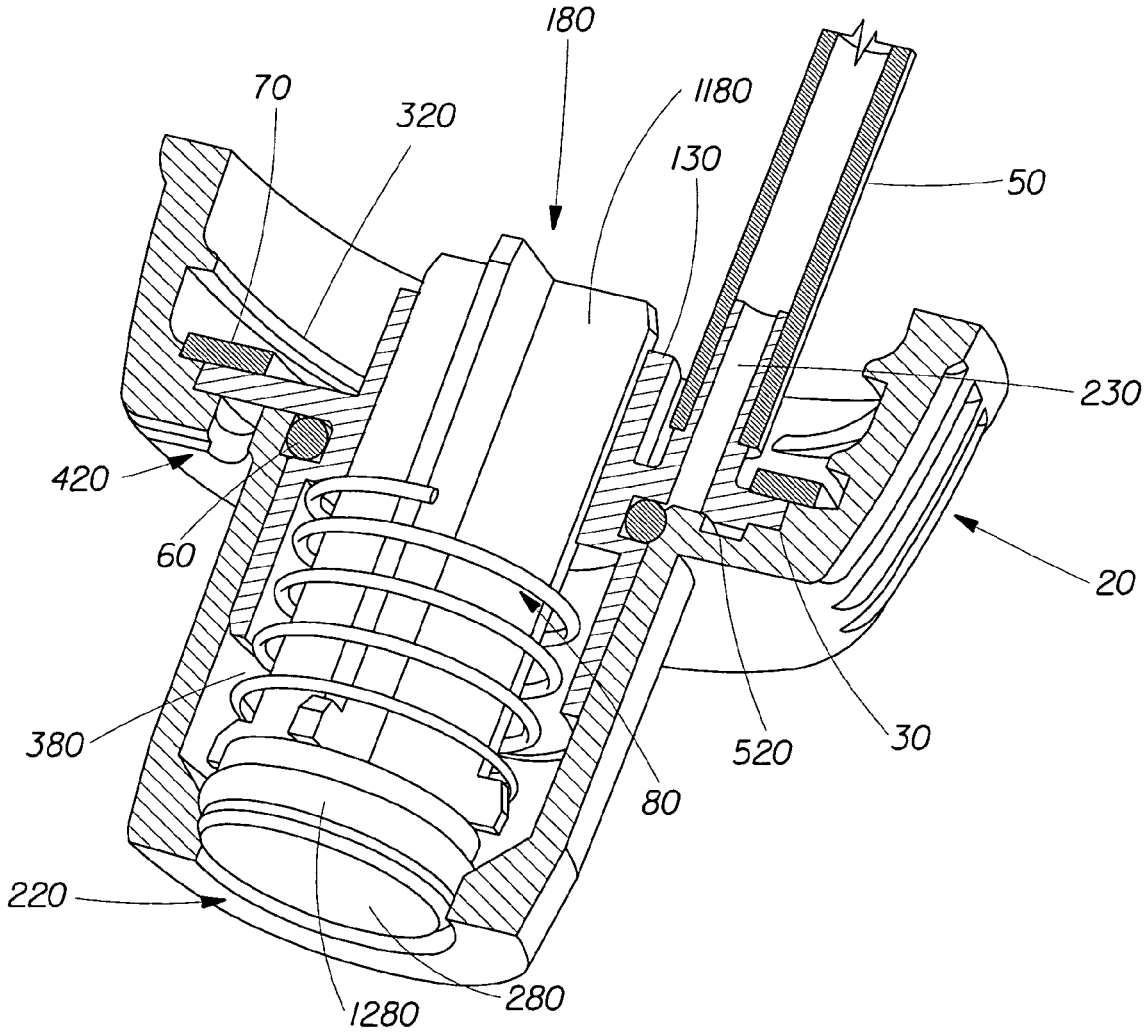
FIG. 3 is a partially cut-out isometric view of the fitment of FIG. 1 shown in a closed position.
Figure 4:
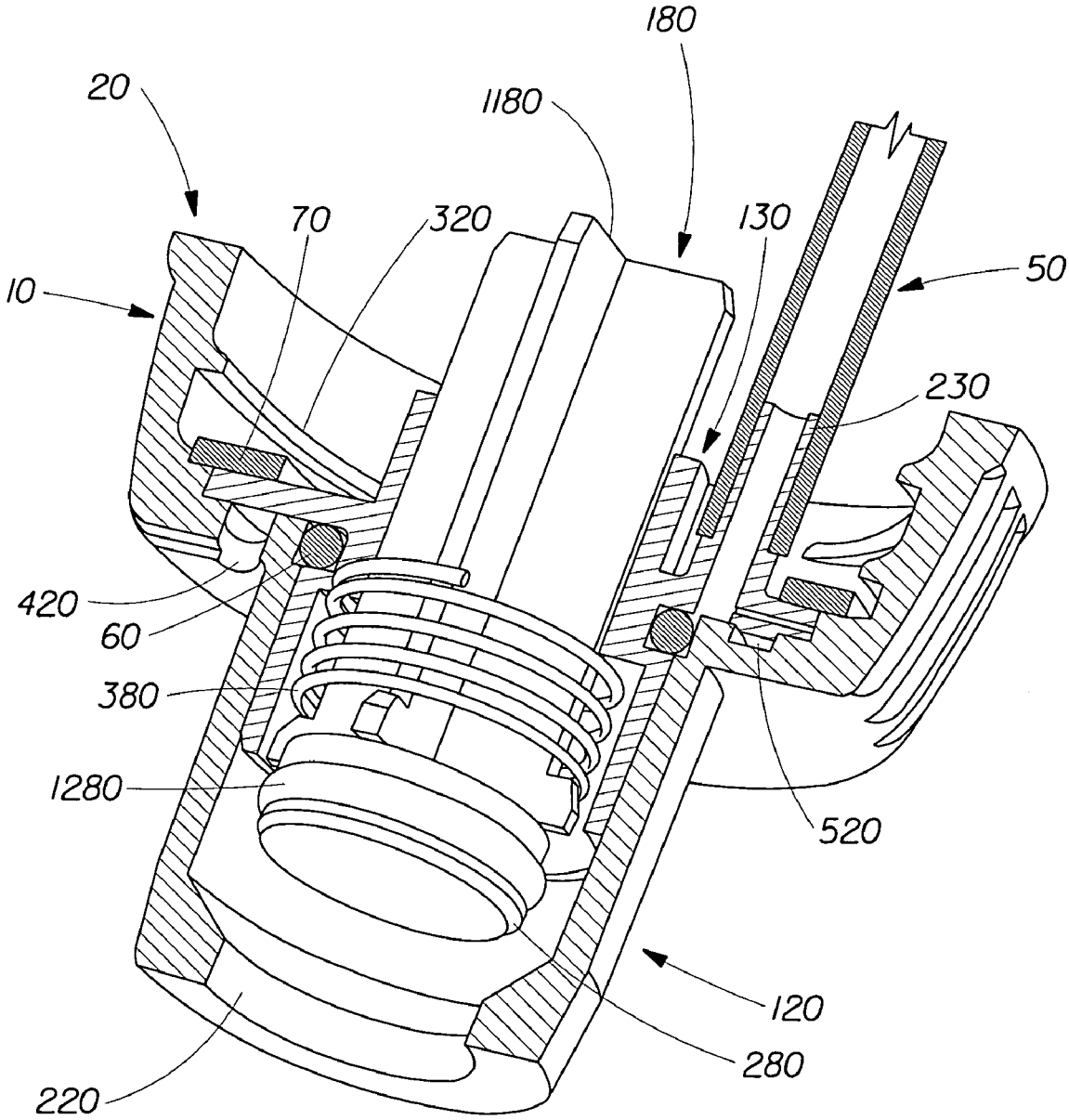
FIG. 4 is a partially cut-out isometric view of the embodiment of FIG. 1 shown in a opened position.

In one embodiment, the fluid transfer fitment 10 comprises a cap portion 20 having an engaging segment 120 with an opening 220 as shown in FIG. 2. In one embodiment, the cap portion 20 and the engaging segment 120 can be made of any kind of plastic materials, metals or any combination thereof. In a preferred embodiment, the cap portion 20 and the engaging segment 120 are made of Copolymer Polypropylene. In one embodiment, the cap portion 20 can be attached to a reservoir (not shown for clarity) but it can be preferred that the cap portion 20 be removably attachable to the finish of a reservoir. In one embodiment, the reservoir can have a base portion connected to a wall portion forming a cavity and a "crown" or top portion which is connected to the wall of the reservoir and which can have a finish portion for receiving the fitment 10. The cap portion 20 can be removably attached to a reservoir with screw threads 320 located on the inner surface of the cap portion, as it is well know in the art, but the cap portion can also be removably attached to a reservoir via a clip member, a bayonet portion or with a plug seal and still provide the same benefits. In one embodiment, the engaging segment 120 can have a substantially cylindrical shape and a height comprised between about 5 mm and 30 mm, an inner diameter comprised between about 5 mm and about 60 mm and an outer diameter comprised between about 6 mm and about 65 mm. In a preferred embodiment, the engaging segment 120 can engage a receiving member of a fluid delivery mechanism which will be later described. One skilled in the art will understand that the engaging segment 120 can have any other shape and still provide the same benefits. Non-limiting examples of suitable cross-sectional shapes can be triangular, rectangular or, more generally, polygonal but it can be preferred that the engaging segment have substantially the same cross-sectional geometric shape as the receiving member. The fluid transfer fitment 10 can comprise an interconnecting member 30, as shown in FIG. 2-4, which can be located within the cap portion 20. For ease of manufacturing, the cap portion and the interconnecting member 30 can be two distinct elements but one skilled will understand that these elements can be manufactured as a single element via a molding process. The interconnecting member 30 can have a fluid transfer opening 130 and a vent opening 230. In one embodiment, a vent valve 40 can be in fluid communication with the vent opening 230 of the interconnecting member 30 via a tube 50 attached in a substantially leak-tight manner to the vent valve 40 and the vent opening 230 such that air from the outside atmosphere can penetrate in the reservoir to compensate the "void" left by the liquid being withdrawn from the reservoir while substantially preventing the liquid in the reservoir from flowing through the vent opening 230. The vent valve can be any known vent valve in the art such as for example, duckbill valve, ball and spring valve, slit valve or a venting membrane comprising a porous materials which allows air transport in one direction but no liquid transport in the opposite direction. In one embodiment, the vent valve 40 can be attached to the end of a tube 50 such that when the fluid transfer fitment is attached to a reservoir filled with a fluid, preferably a liquid, the vent valve 40 is located within the reservoir, in a region substantially adjacent the bottom wall of a reservoir. Among other benefits, the location of the vent valve 40 in a region a region substantially adjacent the bottom wall of the reservoir, minimizes the risk of leakage of the liquid through the check valve 40 when the reservoir is inverted. In one embodiment, the vent valve 40 can be a normally opened type of vent valve which stays substantially opened until it is submersed in a fluid and the pressure of the fluid onto the walls of the valve causes this valve to close. When the normally opened valve is submersed in for example a liquid, air is allowed to flow through the normally opened valve when the pressure differential which is caused by the liquid being withdrawn from the reservoir, forces the vent valve to open and then, to reclose when the pressure is equalized. In another embodiment, the vent valve 40 can be a normally closed type of vent valve, which stays substantially closed even when it is not being submersed in a fluid. When the normally closed valve is submersed in for example a liquid, air is allowed to flow through the normally closed valve when the pressure differential which is caused by the liquid being withdrawn from the reservoir, forces the vent valve to open or "crack" and then, to reclose when the pressure is equalized. In a preferred embodiment, the vent valve 40 is a duckbill valve made of an elastomeric material such as silicones, rubbers, Poly Vinyl Chloride, metallocene catalyzed Low Density Polyethylene and the pressure differential between the outside atmosphere and the reservoir and which causes air to flow through the check valve 40 is between about 0 bar and about 0.5 bars, preferably between about 0 bar and about 0.2 bars. In one embodiment, the vent valve 40 can be located within a substantially rigid shielding member 140 which protects the check valve 40 and reduces the chance that the check valve 40 would accidentally open when the fitment 10 is attached to the finish of a fluid filled reservoir. One skilled in the art will understand that a vent valve 40 in fluid communication with a vent opening may only be required when the reservoir needs to be vented. This might be the case for example, with a reservoir having substantially rigid walls, i.e. walls which do not deform sufficiently to compensate the negative pressure created in the reservoir when the fluid is withdrawn from the reservoir. In one embodiment, the reservoir can be made of a substantially flexible material such as a flexible pouch or sachet, which can deform as the liquid is withdrawn from the reservoir. In another embodiment, the reservoir can have substantially non-deformable walls and a substantially flexible pouch for storing a liquid and being located within the reservoir. As the fluid is withdrawn from the pouch, the pouch is deformed and no venting is necessary. In yet another embodiment, a reservoir having substantially rigid walls can have a vent opening, located for example on the bottom surface of the reservoir. This vent opening can be sealed with a one way valves like an umbrella valve, a ball valve or any of the previously discussed vent valves or with a piece of adhesive tape such that the fluid contained in this reservoir does not leak through this vent opening when the reservoir is in a upright position. The reservoir can also have instructions instructing the user to remove this adhesive tape when the bottle is inverted and/or connected to the fluid delivery mechanism of a cleaning implement. In another embodiment, a user can also be instructed to puncture a wall of the reservoir, preferably the base portion of the reservoir, when the reservoir is inverted and/or fluidically connected to the fluid delivery mechanism.

In one embodiment, the cap portion 20 can have an opening 420 for allowing the vent opening 230 to be in fluid communication with the outside atmosphere. In a preferred embodiment, the cap portion 20 can have a groove 520, preferably a substantially circular groove, located on the inner bottom surface of the cap portion as shown in FIGS. 3 and 4, such that no matter where the vent opening 230 is located relative to the opening 420 of the cap portion, the vent opening is always in fluid communication with the opening 420 of the cap portion 20. A first seal member 60 which can be for example an O-ring allows the interconnecting member 30 to be connected to the cap portion 20 in a substantially leak-tight manner. A second seal member 70, which can have a substantially annular shape prevents the fluid from flowing through the vent opening 230 of the cap portion when the fitment 10 is attached to a reservoir and the reservoir is inverted. The first and the second seal members 60 and 70 can be made of Polyethylene, Polypropylene, Poly Vinyl Chloride, rubbers, silicones, a laminate with foamed Polyethylene or Polypropylene, Ethylene Vinyl Acetate, Ethylene Vinyl Alcohol, Aluminium or any kind of elastomeric materials. The skilled artisan will understand that the first and second seal members 60, 70 may not be required when the cap portion 20 and the interconnecting member 30 are molded as a single element. In one embodiment, the fitment 10 can have a check valve 80 for controlling the flow of fluid being withdrawn from the reservoir. The check valve 80 can have an actuating shaft portion 180 having a first end and a second end. The actuating shaft portion 180 is distally movable within the engaging segment 120 and/or the interconnecting member 30. In a preferred embodiment, the actuating shaft portion 180 can have a substantially cross shape and it can have four fins 1180 slideably movable within the opening 130 of the interconnecting member 30. Without intending to be bound by any theory, it is believed that the fins 1180 act as a guiding means for the check valve 80. The actuating shaft portion 180 can be connected to a piston portion 280 which can have the complementary shape of the opening 220 of the cap portion 20 or the complementary shape of the fluid transfer opening 130 of the interconnecting member 30. This piston portion 280 prevents a fluid from flowing through the opening 220 of the cap portion and/or the fluid transfer opening 130 of the interconnecting member 30 as shown in FIG. 3. In one embodiment, the actuating shaft portion 180 and the piston portion 280 can be made of any type of plastic materials, metals or combinations thereof. In a preferred embodiment, the actuating shaft portion 180 and the piston portion 280 are made of Polyoxymethylene. In a preferred embodiment, the piston portion 280 can have a seal member 1280 which can be an O-ring, and which can seal the opening(s) 220 and/or 130 in a substantially leak-tight manner. In a preferred embodiment, the check valve 80 can be spring-loaded with a spring member 380 which can resiliently maintain the opening(s) 220 and/or 130 closed until enough pressure is applied on the check valve 80 to move the piston portion 280 distally such that a fluid can flow through the openings 220 and 130 as represented in FIG. 4. In a preferred embodiment represented in FIGS. 3 and 4, the check valve 80 is capable of closing the opening 220 of the cap portion 20 which is located in a lower region of the engaging segment 120. In this embodiment, the diameter of the opening 220 is preferably smaller than the diameter of the adjacent inner cylindrical volume of the engaging segment 120 such that the fluid can flow along the actuating shaft portion 180 and around the piston portion 280 and seal member 1280 and then through the opening 220 when the check valve 80 is displaced within the engaging segment 120 as shown in FIG. 4. A user can easily and conveniently attach the previously described fitment to the finish of a fluid filled reservoir and then manipulate this reservoir without having the fluid leak through the opening 220 as the spring-loaded check valve keeps this opening closed. Among other benefits, the previously described fitment minimizes the risk of spillage of a liquid which in one embodiment can be a cleaning solution having at least an active ingredient. A user can also connect the filled reservoir with the fitment to any fluid delivery mechanism which can be used to controllably or permanently apply pressure on the check valve such that the fluid contained in the reservoir flows by gravity from the reservoir when the reservoir is inverted, i.e. when the fitment is substantially pointing downward.

In another embodiment, the check valve 80 can be a movable spring-loaded ball valve or a slit seal valve which can be engaged by a probe.

In another embodiment, the fitment 10 can be attached to the finish of the "crown" portion of a reservoir and an additional cap portion can be attached to the base portion of the reservoir such that a user can refill the reservoir through the additional cap when the reservoir is inverted.

One skilled in the art will understand that the previously described fitment can be used with any fluid delivery mechanism having a receiving member.

II. Fluid delivery Mechanism.

Another aspect of the invention is related to fluid delivery mechanisms and in particular cleaning implements having a fluid delivery mechanism comprising a receiving member, which can be used in combination with the previously described fluid transfer fitment.

Figure 5:
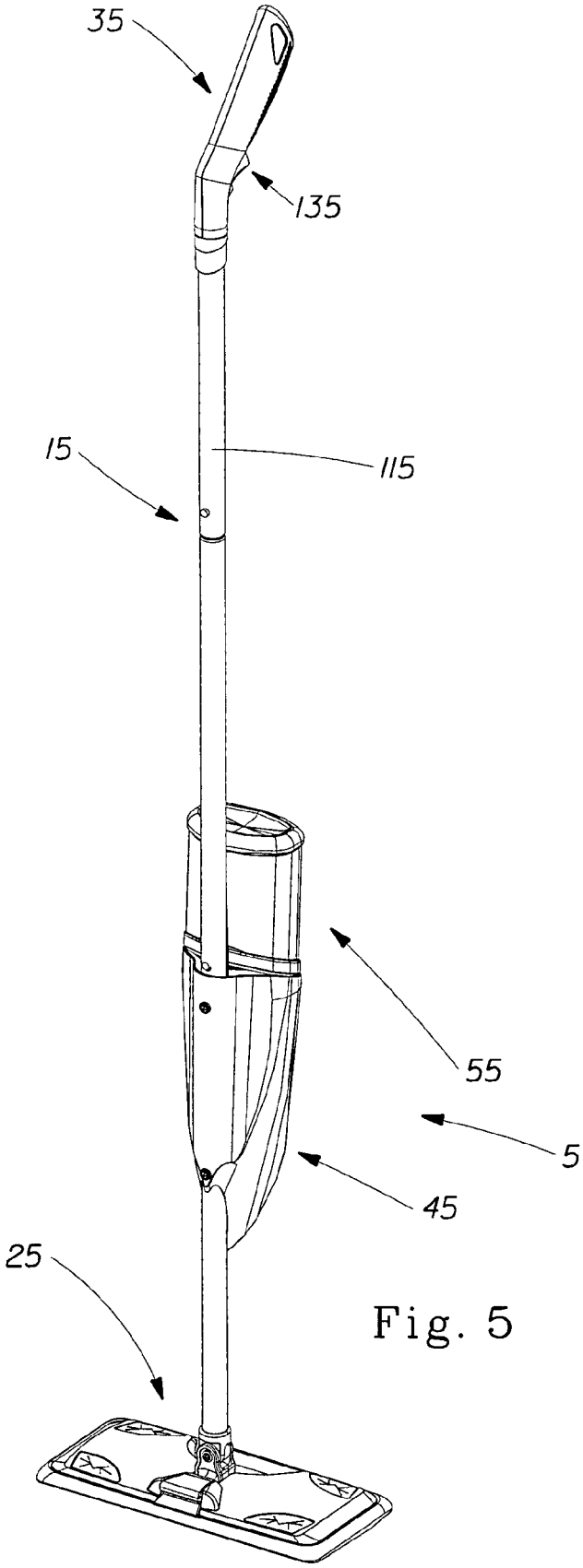
FIG. 5 is an isometric view of a cleaning implement of the present invention.

Referring to FIG. 5, a cleaning implement 5 having a fluid delivery mechanism is represented. In one embodiment, the cleaning implement 5 comprises a handle 15, rotatably attached at one end to a mop head 25 suitable for retaining an absorbent cleaning pad or cleaning sheet (not shown for clarity) and at the other end to a pistol-grip 35 comprising a trigger member 135. The handle of the cleaning implement can have a single pole segment but preferably comprises a plurality of pole segments 115 which can be releasably attached to each other. A suitable locking mechanism for permanently or releasably attach two consecutive pole segments is described in copending U.S. application Ser. No. 60/409,261 to Hofte et al., filed Sep. 9, 2002 and assigned to The Procter and Gamble Company.

In one embodiment, the cleaning implement comprises a housing 45 for enclosing a fluid delivery mechanism and receiving at least a portion of a reservoir 55 and which is attached to the handle 15.

Figure 6:
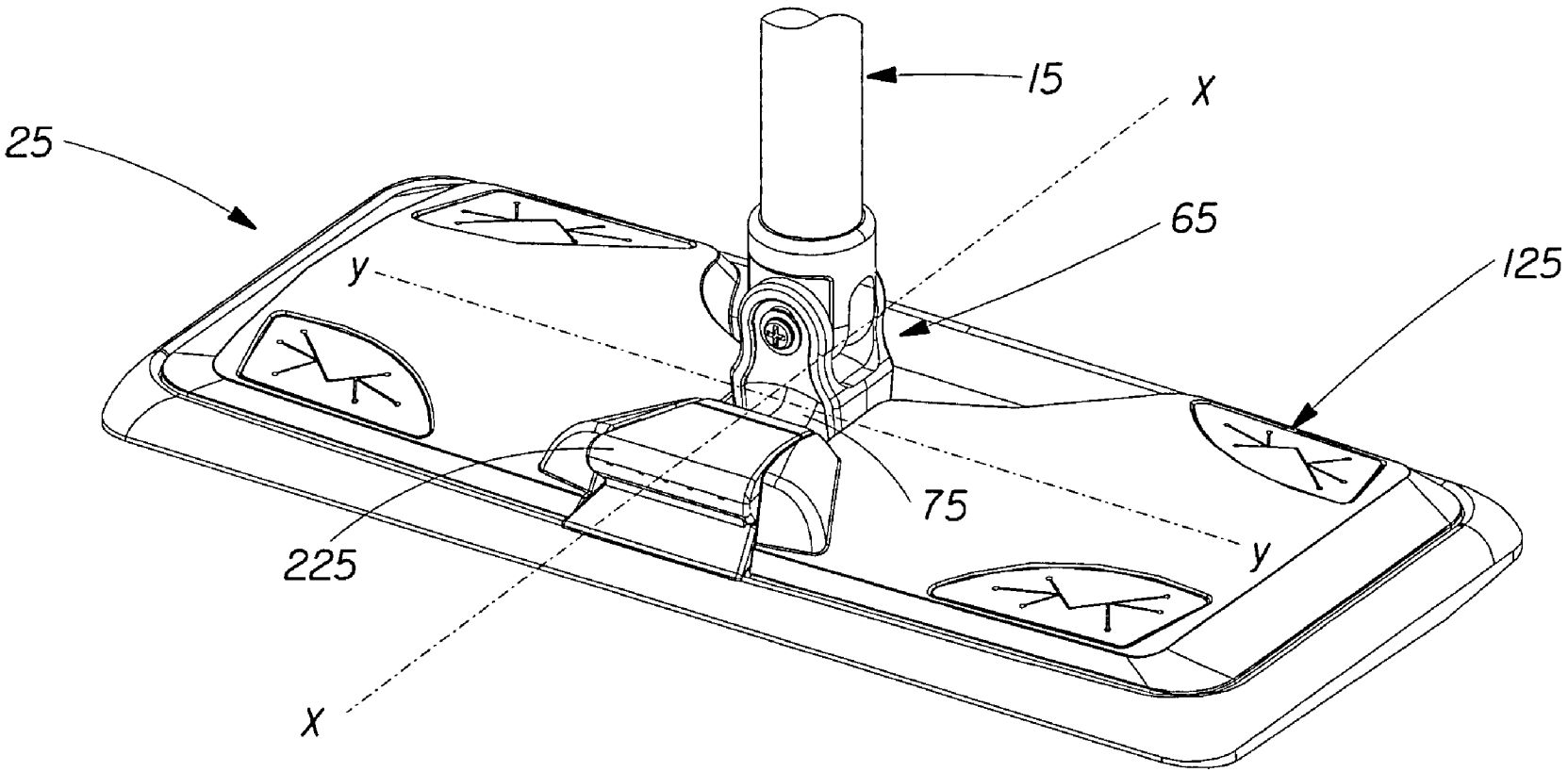
FIG. 6 is an isometric view of a mop head of the cleaning implement shown in FIG. 5.

FIG. 6 shows the lower portion of the handle 15 which can be rotatably attached to the mop head 25 via a universal joint 65 having two rotational axes. In one embodiment, the handle 15 is attached to the top surface of the mop head via a universal joint 65 having a first and a second rotational axis X-X and Y-Y where the first rotational axis X-X is substantially perpendicular to the second rotational axis Y-Y. In a preferred embodiment the first and second rotational axes of the universal joint 65 are located in two different planes as shown in FIG. 6. In one embodiment, the mop head comprises at least one but preferably four grippers 125 for engaging and retaining an absorbent cleaning pad or a cleaning sheet about the mop head 25. A non-limiting example of suitable grippers can be found in copending U.S. patent application Ser. No. 10/216,117 to Kingry et al., filed Aug. 9, 2002, and assigned to The Procter and Gamble Company. In another embodiment, hook fasteners can be attached to the mop head 25, preferably to the lower surface of the mop head, for engaging corresponding loop fasteners, which can be located on an absorbent cleaning pad or cleaning sheet, preferably to the top surface of a cleaning pad or cleaning sheet. In a preferred embodiment, a nozzle 225 is attached to the top surface of the mop head 25 and is substantially adjacent to the leading edge of the mop head 25. In one embodiment, the cleaning implement comprises at least one nozzle 225 which can be fixedly or releasably attached to the mop head 25. One skilled in the art will understand that the nozzle 225 can also be attached to the universal joint 65 or the handle 15 and still provide the same benefits. The nozzle 225 can be any nozzle known in the art, which is suitable for generating at least one stream of fluid. In one embodiment, the nozzle 225 is capable of generating at least one, preferably between 1 and 10, continuous streams of fluid. In another embodiment, the nozzle 225 is capable of generating at least one discontinuous stream of fluid. In one embodiment represented in FIG. 7, the nozzle (not shown) can be in fluid communication with the fluid delivery mechanism 12 located in the housing 45 via a tube 75. The tube 75 can be made of any type of material suitable for conveying a fluid in a substantially leak-tight manner. Non limiting examples of material suitable for the tube can be Polyurethane, Poly Vinyl Chloride, Polyethylene, Polypropylene, metallocene catalyzed resins or any mixtures thereof. In a preferred embodiment, the tube 75 can be inserted through an opening 215 located radially in the handle 15. This opening 215 is preferably located in a portion of the handle 15 which is at least partially covered by the housing 45 and then the tube 75 runs along the handle 15 towards the mop head 25. In one embodiment, the tube 75 can extend or exit from a lower portion of the handle 15 through an opening located radially on a portion of the handle 15, preferably located adjacent the mop head 25. In a preferred embodiment, represented in FIG. 8A the tube 75 extends from the distal end of the handle 15 and passes within the universal joint 65. Among other benefits, the location of the tube 75 within the handle 15 and preferably within the universal joint 65, prevents the tube from getting entangled with the handle 15 when the user is cleaning a hard surface such a floor. The location of the tube 75 within the handle 15 and preferably within the universal joint 65 also minimizes the risk of the tube being damaged during use, transport, packaging and/or storage of the implement. In one embodiment, the tube 75 can be located outside the handle 15. In this embodiment, the tube 75 can be located within the universal joint 65 or alternatively can go around the universal joint 65 and the handle 15.

Figure 8A:
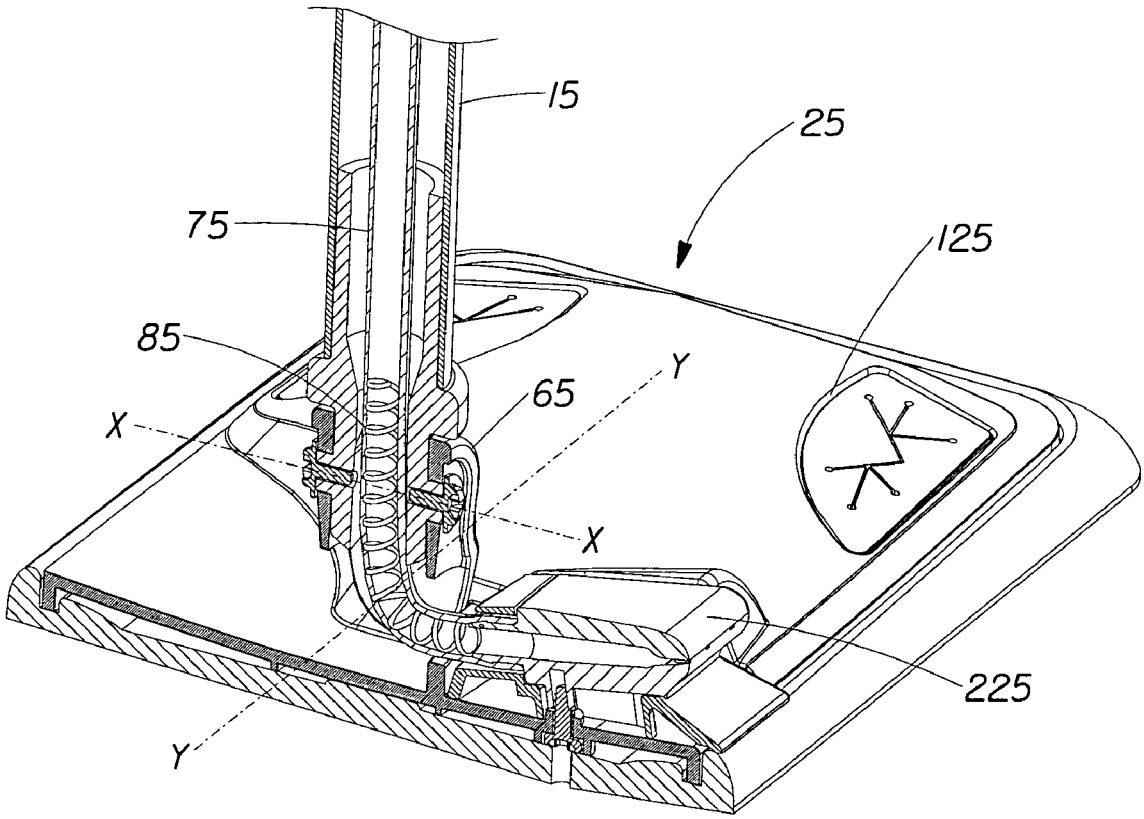
FIG. 8A is a partially cut-out isometric view of the mop head of FIG. 6.
Figure 8B:
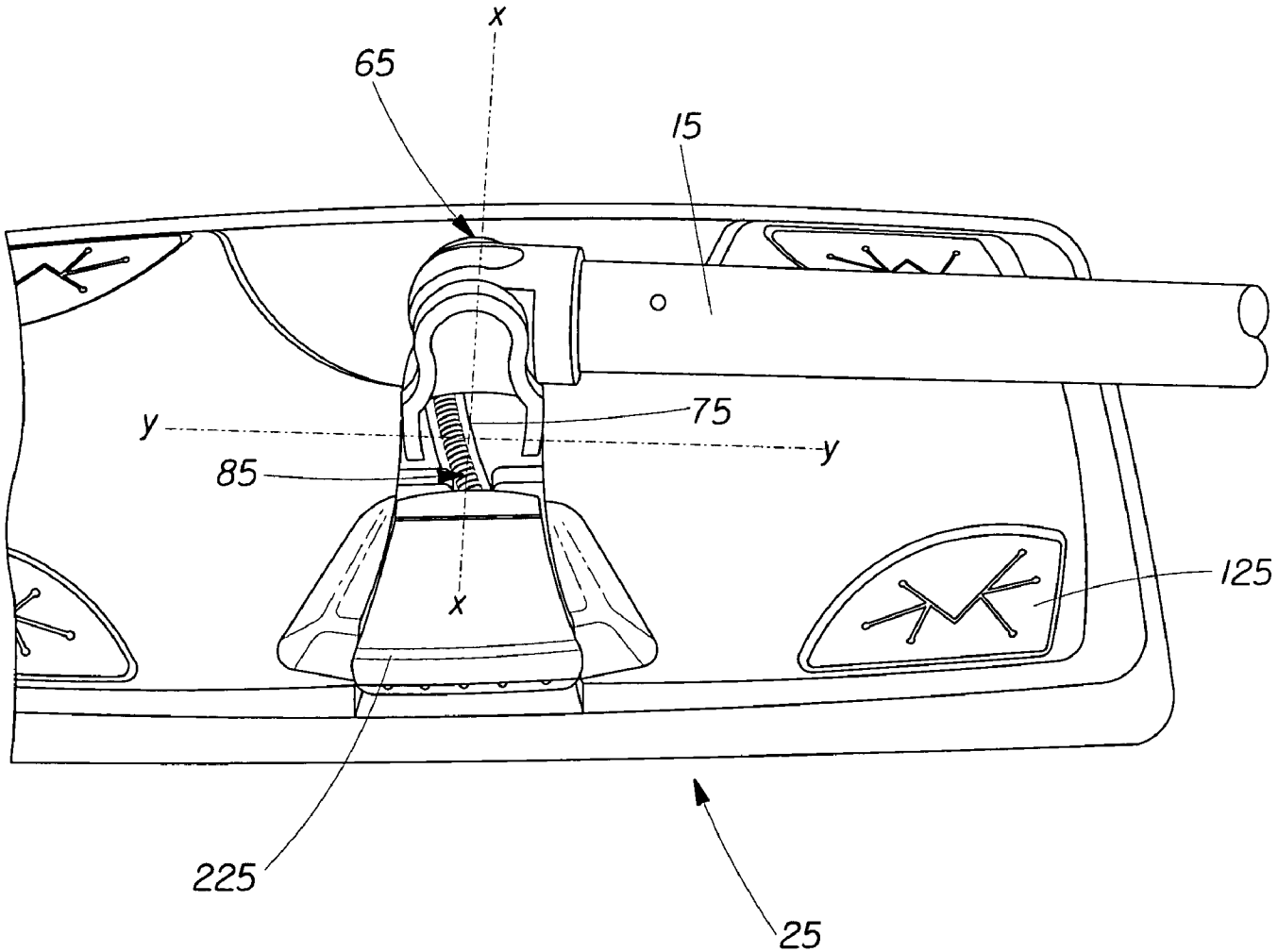
FIG. 8B is an isometric view of the embodiment of the invention shown in FIG. 8A.
Figure 8C:
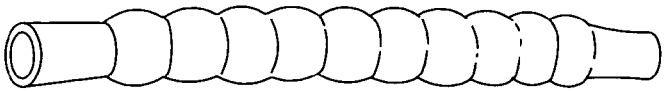
FIG. 8C is an isometric view of a resilient member according to the invention.
Figure 8D:
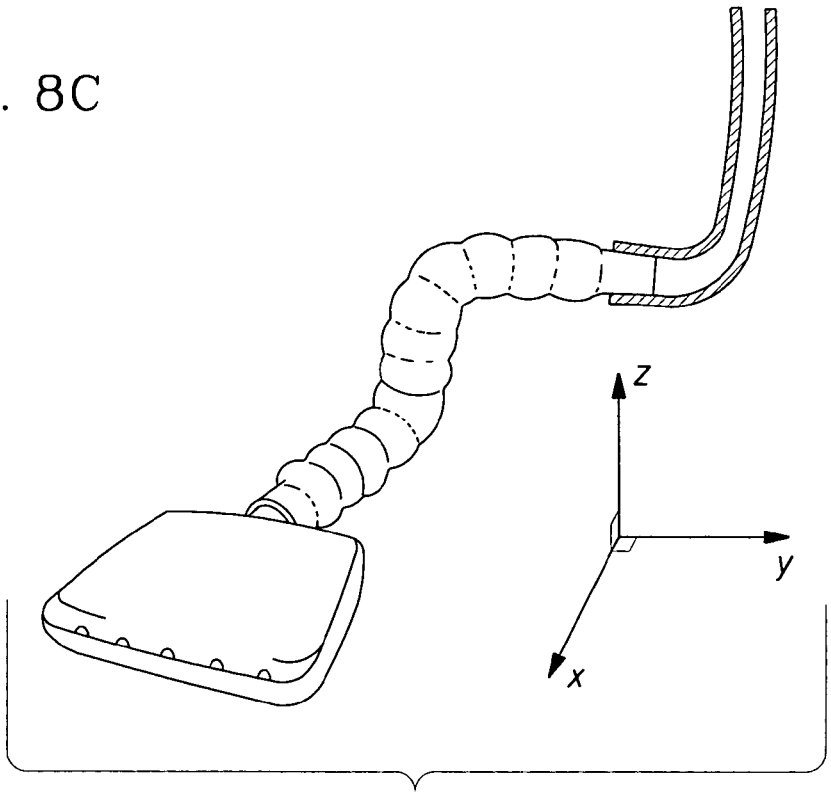
FIG. 8D is an isometric view of the resilient member of FIG. 8C in fluid communication with a nozzle.

Optionally but preferably, at least one resilient member 85 can be located about the portion of the tube 75 which is located within the universal joint 65 as shown in FIG. 8A. Without intending to be bound by any theory, it is believed that when the handle 15 is moved at an extreme angle relative to the mop head 25, i.e. when the handle is substantially parallel to the top surface of the mop head 25, the tube 75 can be pinched. Depending on the mechanical properties of the material used to manufacture the tube 75 (such as elasticity or recovery properties), the pinching of the tube 75 can result potentially in a permanent deformation of the tube 75 which, in turn, can impact on the flow rate of a fluid flowing within the tube 75 as well as the spray pattern generated by the nozzle 225 of the cleaning implement. The impact on the flow rate or spray pattern can be noticeable when the cleaning implement is a gravity fed implement, such as the one which will later be described and which uses gravity for conveying the fluid from the reservoir to the nozzle 225. A portion of the tube 75 located within the universal joint can be pinched when the portion of the handle rotatably attached to the mop head is "leaning" substantially against the top surface of the mop head 25 as shown in FIG. 8B. This situation can happen when the cleaning implement is packaged in a box or a carton to be shipped, stored and displayed in a store. While being capable of being deformed to the same extent that the tube 75, the resilient member 85 returns to its original shape when the angle between the handle 15 and the mop head 25 is not as acute. The resilient member 85 can be such that it substantially restores the shape of the portion of the tube which has been pinched, therefore offering less resistance or frictions to the fluid flowing within the tube 75. In one embodiment, the resilient member 85 can be a spring made of stainless steel and can be located outside but preferably within the inner portion of the tube 75 which is located within the universal joint 65. In another embodiment, the resilient member 85 can be a hollow member having a substantially corrugated shape as shown in FIGS. 8C and 8D. This corrugated shape hollow member can be located substantially around or within the portion of the tube located within the universal joint 65. In another embodiment, a corrugated shape hollow member can be used to fluidically connect a portion of the tube 75 located above the universal joint 65, to a portion of the tube which is in fluid communication with the nozzle 225 or even directly to the nozzle 225. The shape recovery property of the resilient member 85 contributes to minimize the frictions and turbulences of the liquid which is flowing down to the nozzle 225 and, as a result, optimizes the flow rate of the liquid and the spray pattern generated by the nozzle 225.

II. (a) Gravity Fed Fluid Delivery Mechanism.

Figure 9:
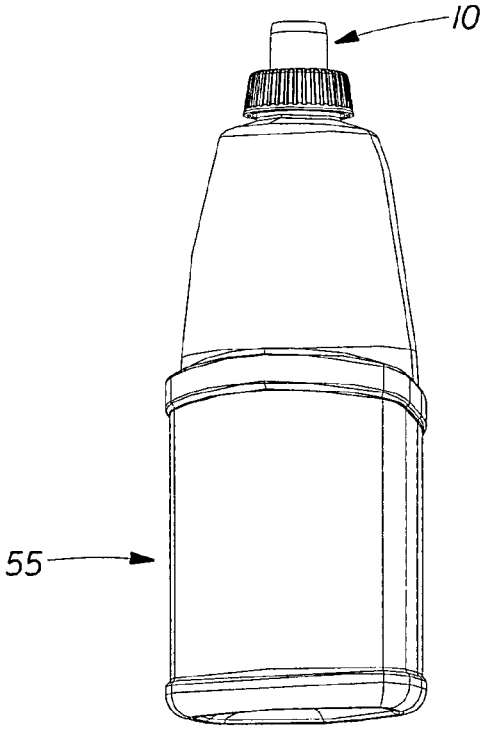
FIG. 9 is an isometric view of a reservoir of the present invention.

As previously discussed, the fluid delivery fitment can be attached to a fluid filled reservoir, as represented in FIG. 9 and can inverted and then be connected to a fluid delivery mechanism of a cleaning implement having a receiving member.

Figure 7:
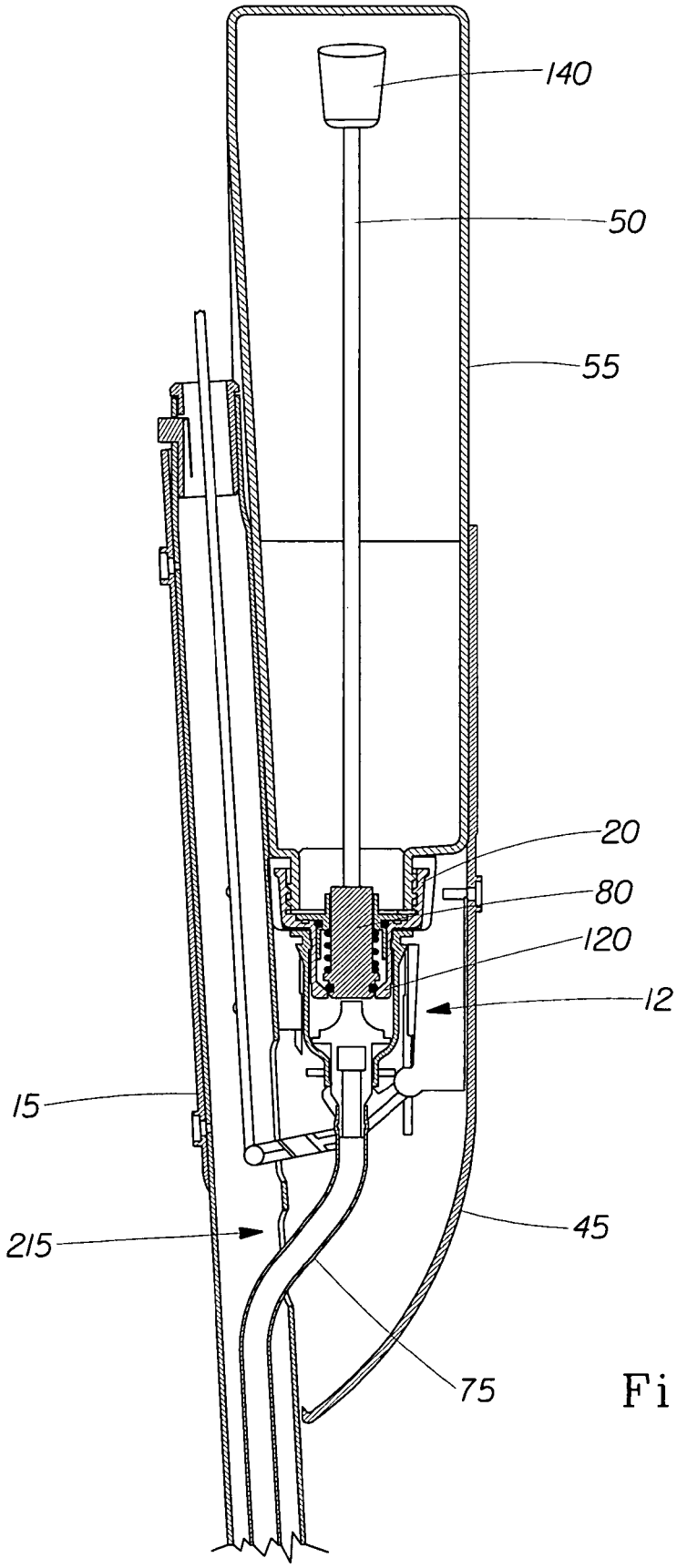
FIG. 7 is a partial cross section view of the cleaning implement shown in FIG. 5.
Figure 10:
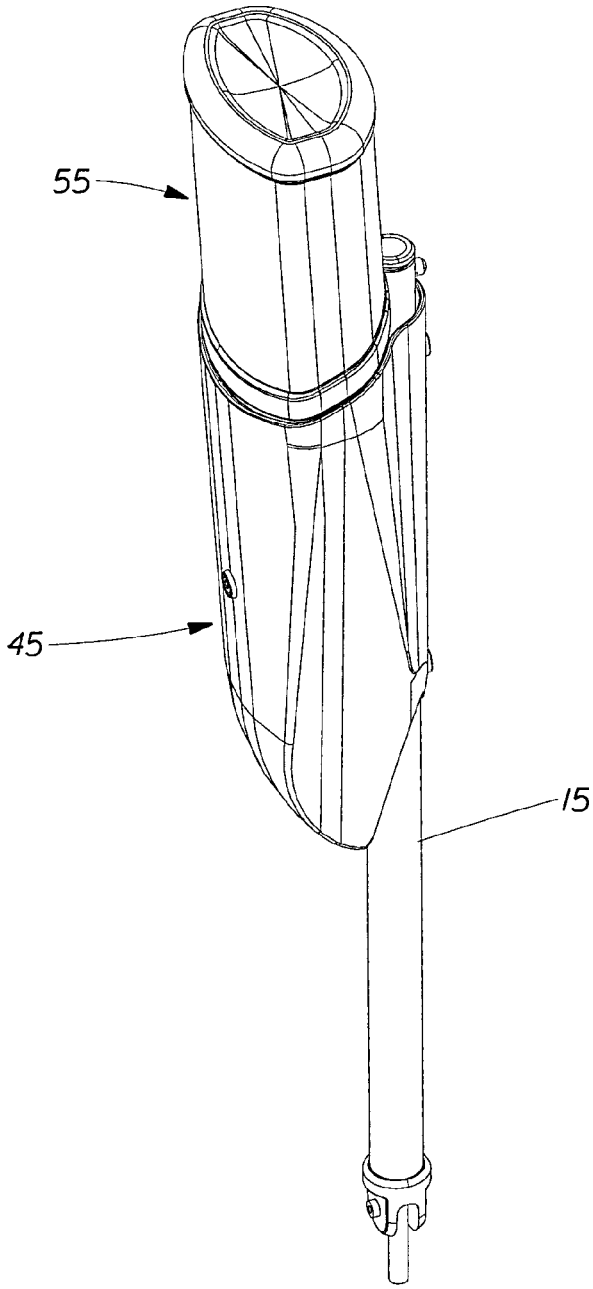
FIG. 10 is a partial isometric view of the reservoir of FIG. 9 inserted in the housing of a cleaning implement.

For clarity purposes, FIG. 10 shows a portion of the handle of the cleaning implement having a housing 45 into which at least a portion of a fluid filled reservoir 55 is inserted. In one embodiment, the housing 45 forms a cavity, as shown in FIG. 7, where the functional elements of the fluid delivery mechanism 12 are preferably located and which allows a user to insert at least a portion of a reservoir 55. One skilled in the art will understand that for a cleaning implement having a gravity fed fluid delivery mechanism, it can be preferred that the fluid filled reservoir and the fluid delivery fitment as shown in FIG. 9, be inserted in the housing 45 such that the fitment, which is attached to the reservoir 55, points in a substantially downward direction.

Figure 11:
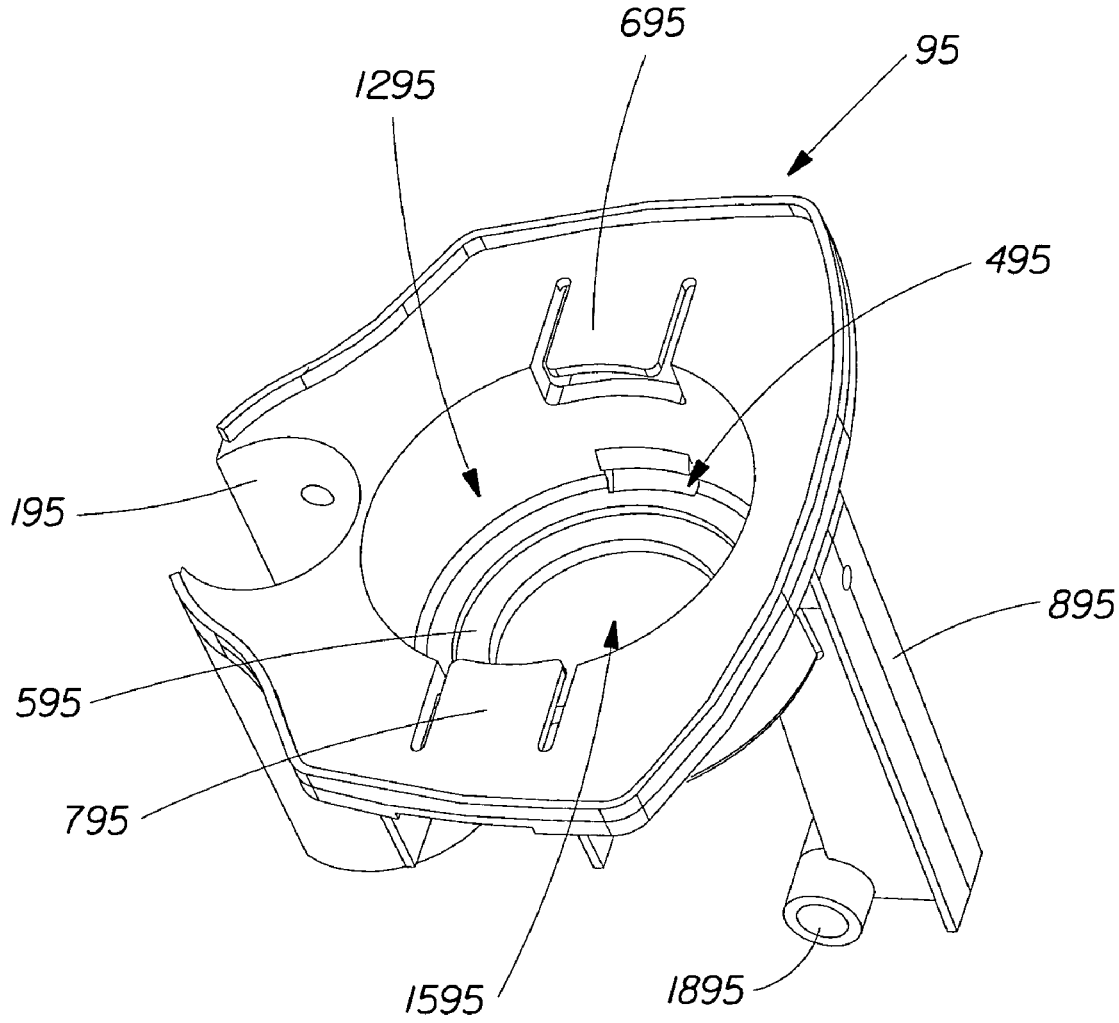
FIG. 11 is an isometric view of a docking member of the present invention.

In one embodiment, a docking member 95, represented in FIG. 11, can be attached to the housing and/or the handle of the cleaning implement via screws, rivets, clips, adhesive or any molding or welding process as it is known in the art. In a one embodiment, the docking member 95 can be made of any type of plastic material, metals or any combination thereof. In a preferred embodiment, the docking member 95 is made of Acrylonitrile-Butadiene-Styrene polymer. In a preferred embodiment, the docking member 95 comprises a cylindrical portion 195 for connecting and attaching the docking member 95 to the handle of the cleaning implement. In one embodiment, the docking member 95 comprises a top surface 295 having an upper opening 1295, a wall 395 extending downwardly from the top surface 295 and forming a cavity 495 for receiving at least a portion of the fluid delivery fitment previously described and a bottom surface 595 connected to the wall 395 and having a lower opening 1595. In a preferred embodiment, the upper and lower openings, 1295 and 1595, are substantially circular. In one embodiment, the diameter of the upper opening 1295 is greater than the diameter of the lower opening 1595. In a preferred embodiment, the diameter of the upper opening is slightly greater than the diameter of the cap portion 20 of the fluid delivery fitment 10 and the diameter of the lower opening 1595 is slightly greater than the diameter of the engaging segment 120 of the fluid delivery fitment 10 such that the cap portion and the engaging segment of the fluid delivery fitment 10 fit within the cavity 495 of the docking member 95 and such that the engaging segment 120 can extend through the lower opening 1595.

In one embodiment, the docking member 95 comprises at least one but preferably two flexible snapping members 695 and 795. Each snapping member 695 and 795, can be deflected in a substantially downward and/or upward direction when the fluid transfer fitment, which is connected to the reservoir, is respectively inserted and/or removed from the housing and the cavity 495 of the docking member 95. When the cap portion 120 of the fluid delivery fitment 10 is located within the cavity 495 of the docking member 95 and past the snapping members 695, 795, each snapping member 695, 795 returns suddenly to its original position and generate an audible signal. Among other benefits, the snapping members 695 and 795 provide an audible signal informing the user that the reservoir has been properly inserted in the housing. The snapping members 695 and 795 also act as a snapping/locking device maintaining the fitment in place in the cavity 495 of the docking member 95 and therefore the reservoir within the housing of the cleaning implement. The reservoir 55 is properly maintained within the housing until a sufficient pulling or extracting force is applied by the user on the reservoir in order to disengage the reservoir from the housing 45.

Figure 12:
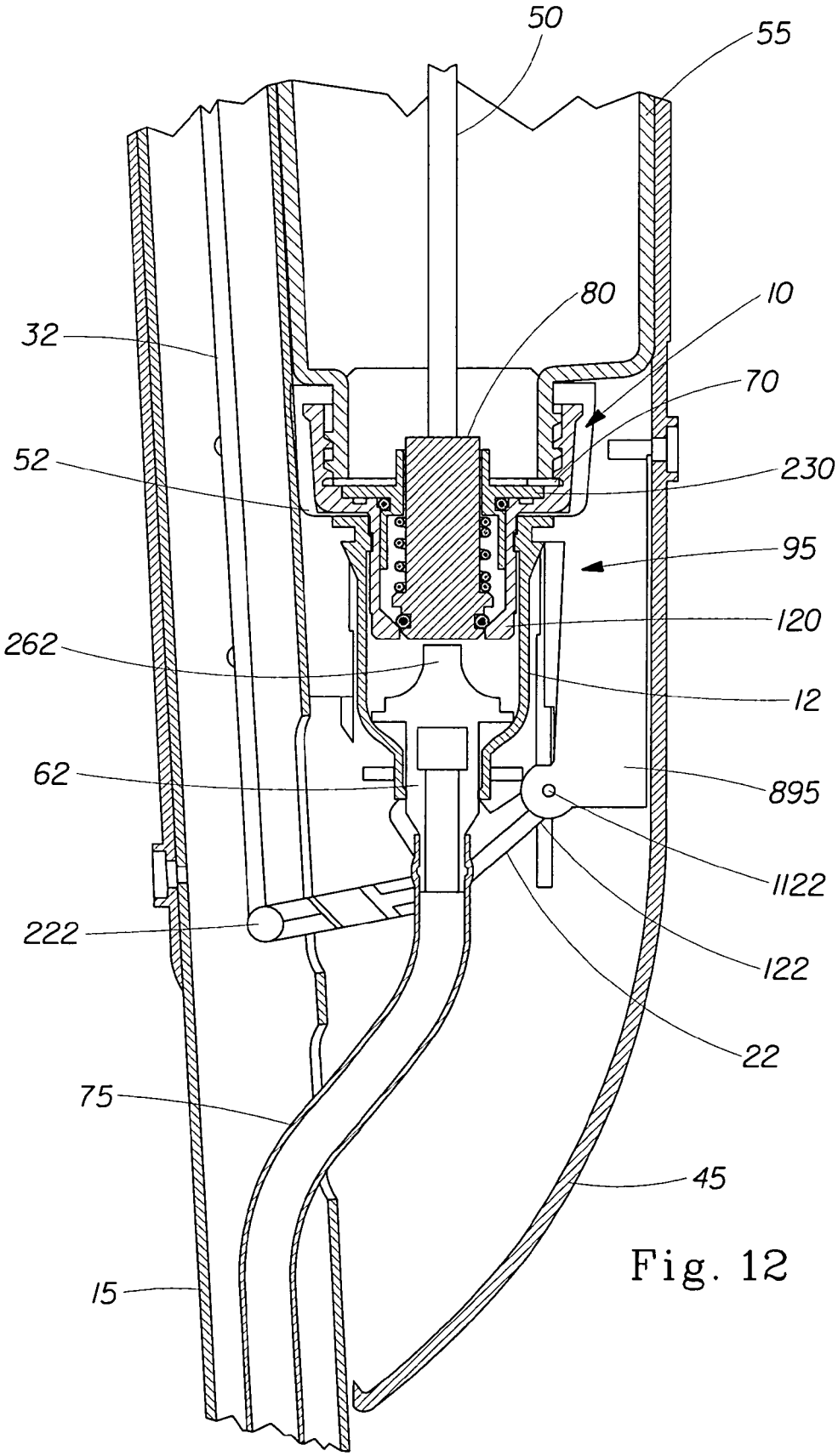
FIG. 12 is a partial cross section view of the an embodiment of the invention.

For clarity purposes, FIG. 12 shows the housing 45 attached to the handle 15, a fluid delivery mechanism 12 connected to the docking member 95 as well as the fluid delivery fitment 10 connected to the reservoir 55 and which is in communication with the fluid delivery mechanism 12.

In one embodiment, the fluid delivery mechanism 12 can be controllably actuated by a lever member 22 which comprises a first end 122 and a second end 222. In a preferred embodiment, the first end 122 of the lever member 22 is pivotably connected via a pin or protrusion to a non-moving part of the cleaning implement. In one embodiment, the first end 122 of the lever member 22 is pivotably connected to the housing 45. In a preferred embodiment, the first end of the lever member 22 is pivotably connected to an extending portion 895 of the docking member 95 via an opening 1895 shown in FIG. 11. In one embodiment, the second end 222 of the lever member 22 is connected to a longitudinal member 32 such that an upward motion of the longitudinal member 32 causes the lever member 22 to pivot about the pivot point 1122 and to actuate the fluid delivery mechanism 12. The longitudinal member 32 can be any apparatus or device capable of applying a pulling force to the lever member 22 such as to cause the rotation of the lever member 22 about the pivot point 1122. The longitudinal member 32 is connected to an actuation mechanism which can be a trigger member 135 (shown in FIG. 5) which can be located about the upper portion of the handle 15, preferably in the hand-grip 35, such that a user can controllably actuate the fluid delivery mechanism 12 via the longitudinal member 32 and the lever member 22. In one embodiment, the longitudinal member 32 can be a rod made of a substantially rigid material. In another embodiment, the longitudinal member can be a cable, a rope, a wire or a tape. In a preferred embodiment, the longitudinal member 32 is a tape which can be put under tension by a self-tensioning mechanism such as the one disclosed in copending U.S. patent application 60/409,261 to Hofte et al., filed Sep. 9, 2002 and assigned to The Procter and Gamble Company. When this tape is tensioned, a user can controllably pull on the tape, which is windably connected to a spring-loaded winding member, by squeezing a trigger member.

Figure 13:
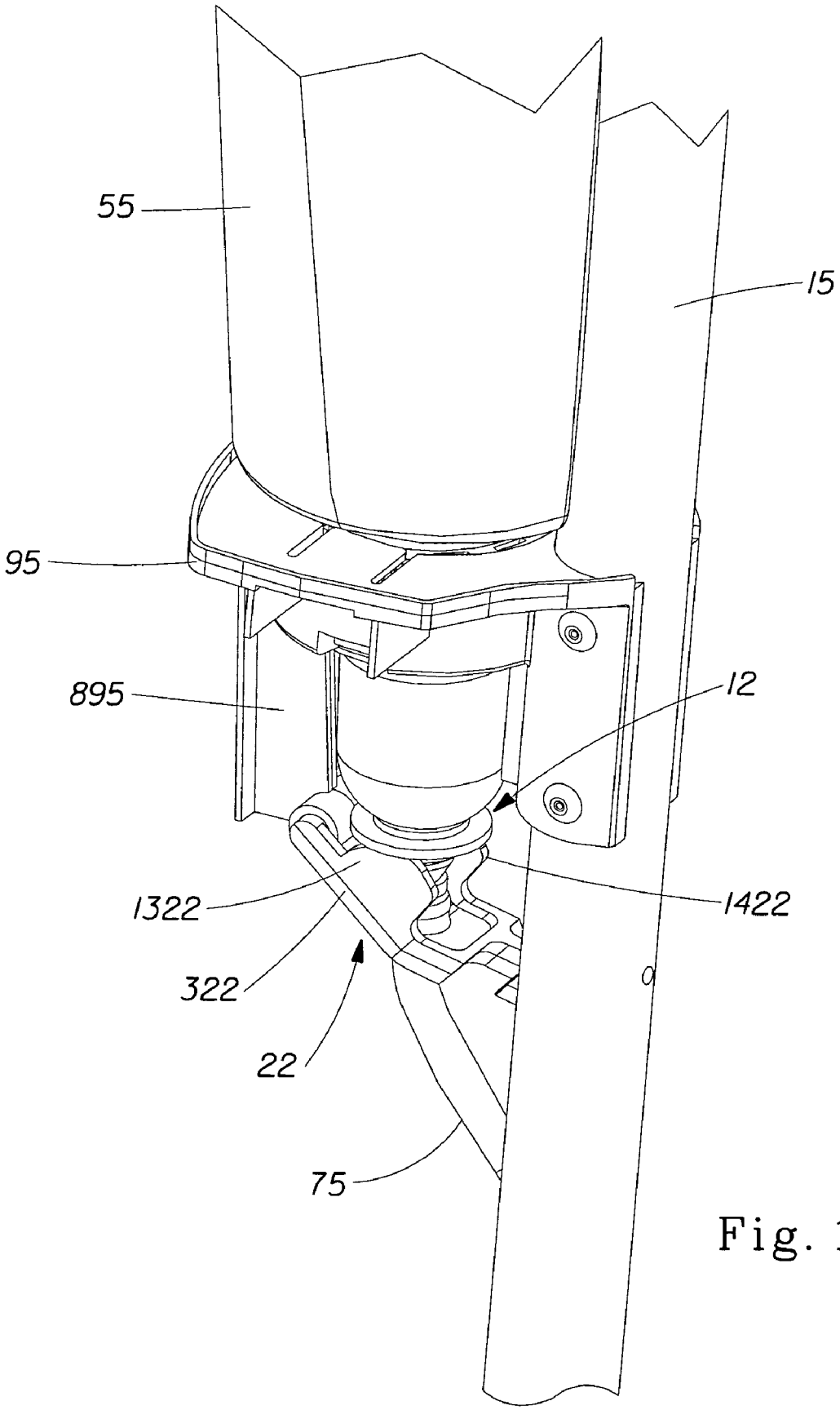
FIG. 13 is a partial isometric view of the embodiment of FIG. 12.

FIG. 13 shows the lever member 22 pivotably attached to the extending portion 895 of the docking member 95 with the fluid delivery mechanism 12 and a portion of the reservoir 55 covered by the housing (not shown for clarity purposes).

In one embodiment, the lever member 22 has a substantially "fork" shape and comprises a right arm portion 322 and an opposing left arm portion 422. In a preferred embodiment, the right and left arm portions 322, 422 are pivotably connected to the extending portion 895 of the docking member 95. In one embodiment, the right and/or left arm portions 322, 422 can have at least one but preferably two ear portions 1322, 1422 extending upwardly from the right and/or left arm portion. The ear portions are capable of contacting and lifting in a substantially upward direction a clipping member 72 of the fluid delivery mechanism 12 when the longitudinal member pulls on the lever member 22.

Figure 14:
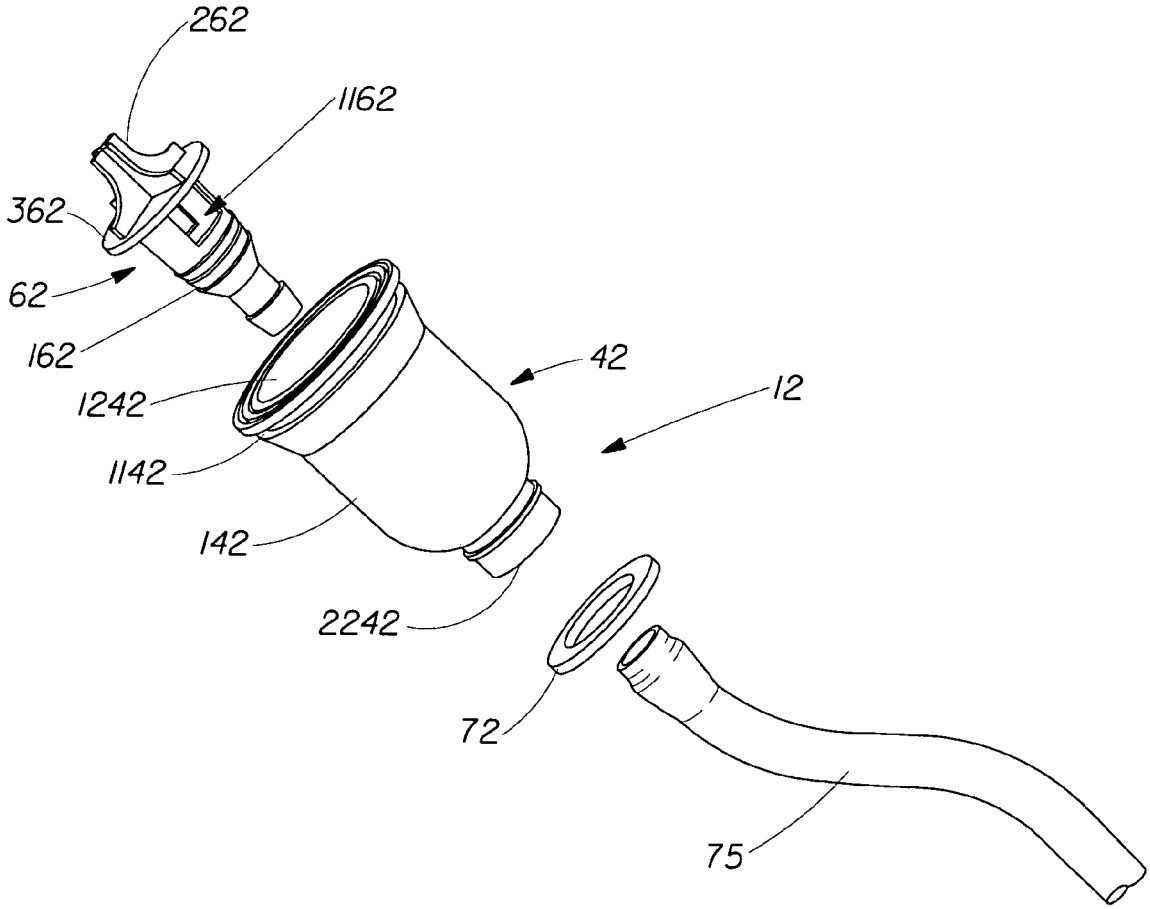
FIG. 14 is an exploded isometric view of a portion of a fluid delivery mechanism of the invention.
Figure 15:
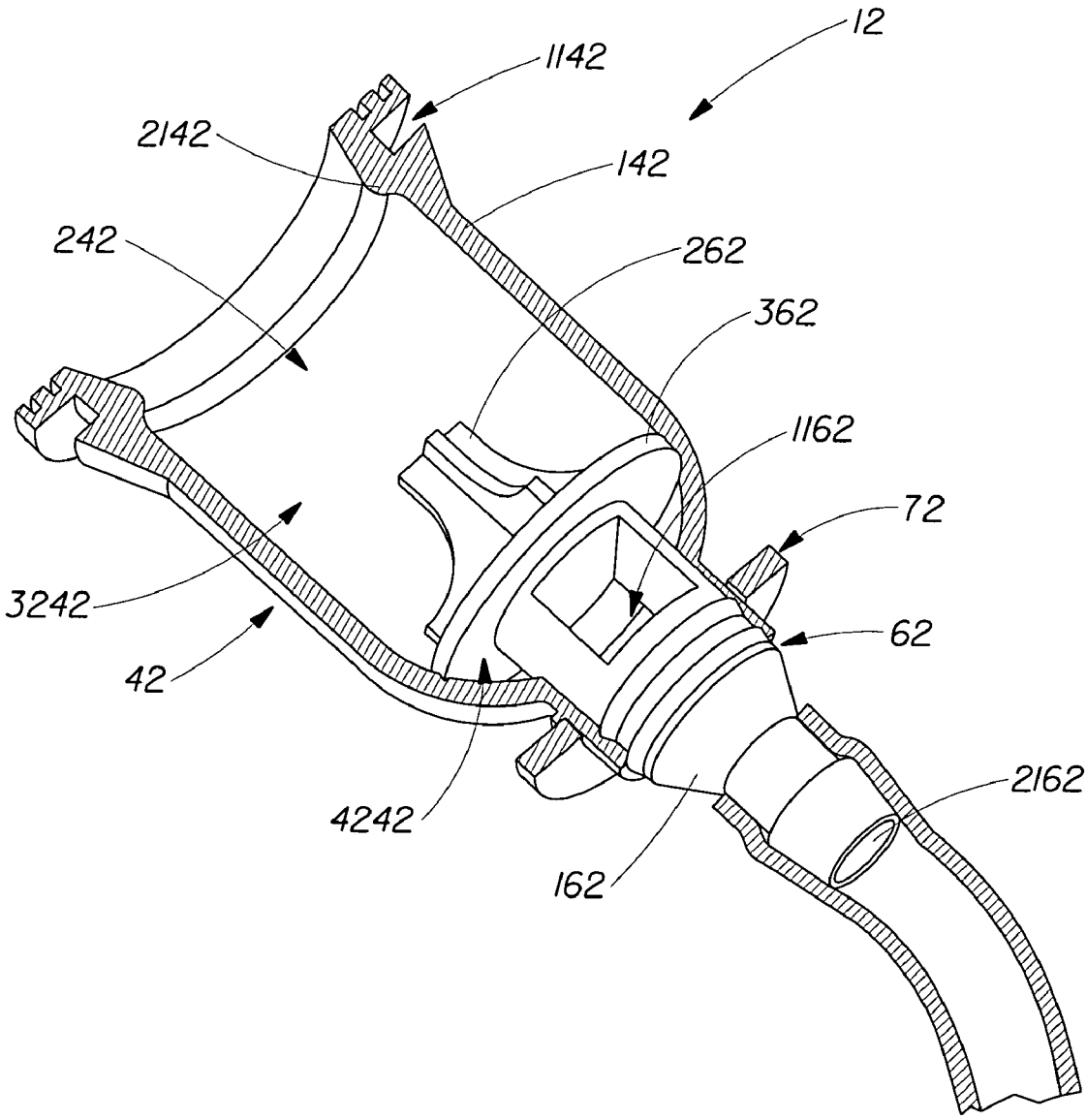
FIG. 15 is a partially cut-out isometric view of the embodiment shown in FIG. 14 in a closed position.
Figure 16:
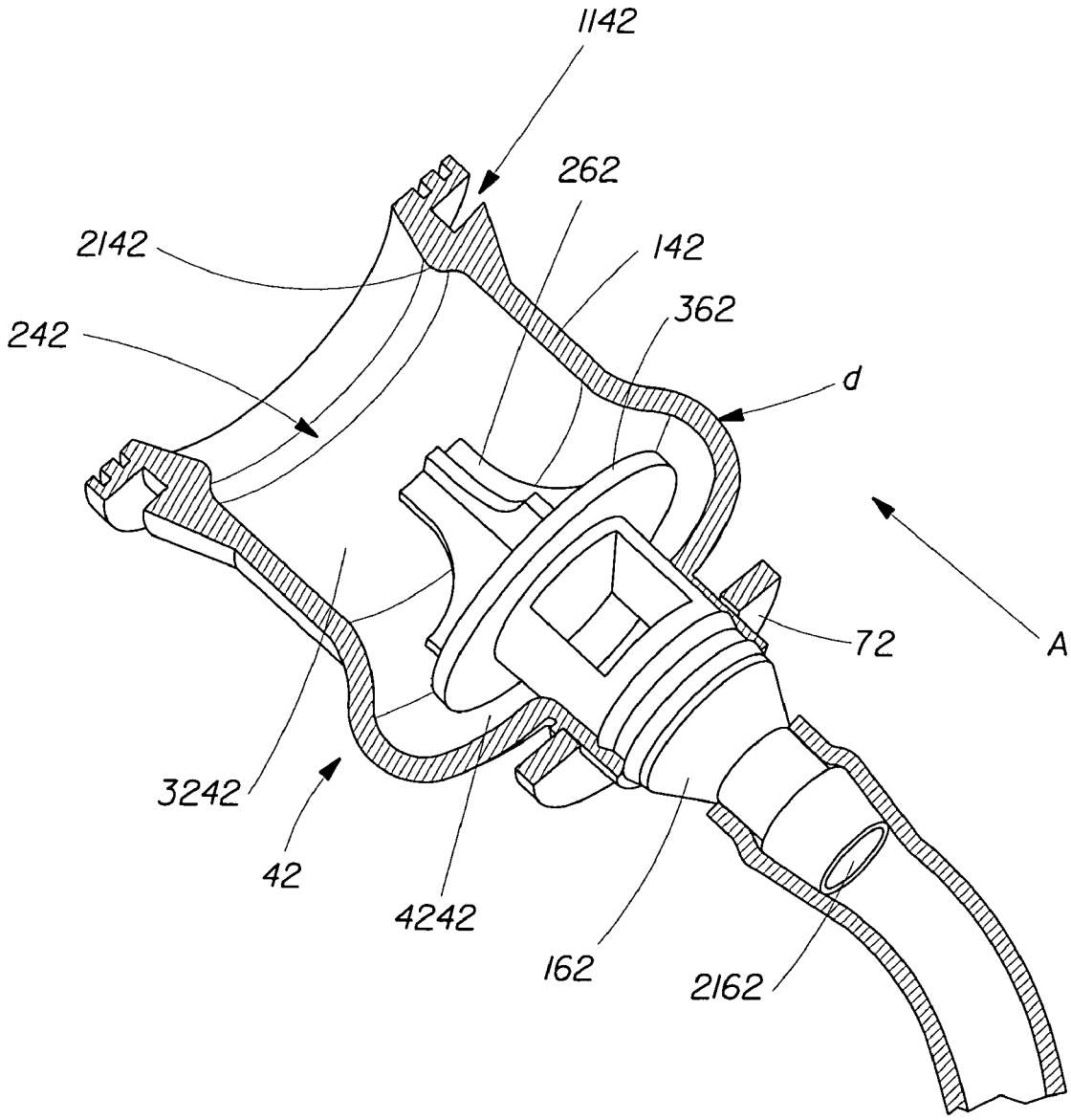
FIG. 16 is a partially cut-out isometric view of the embodiment shown in FIG. 14 in an opened position.
Figure 17:
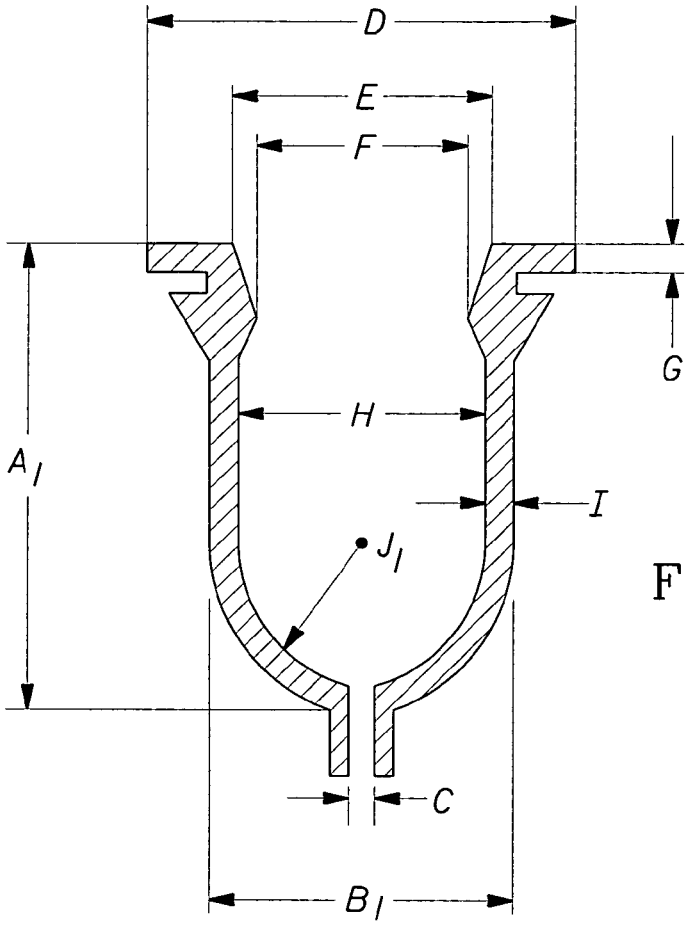
Figure 18:
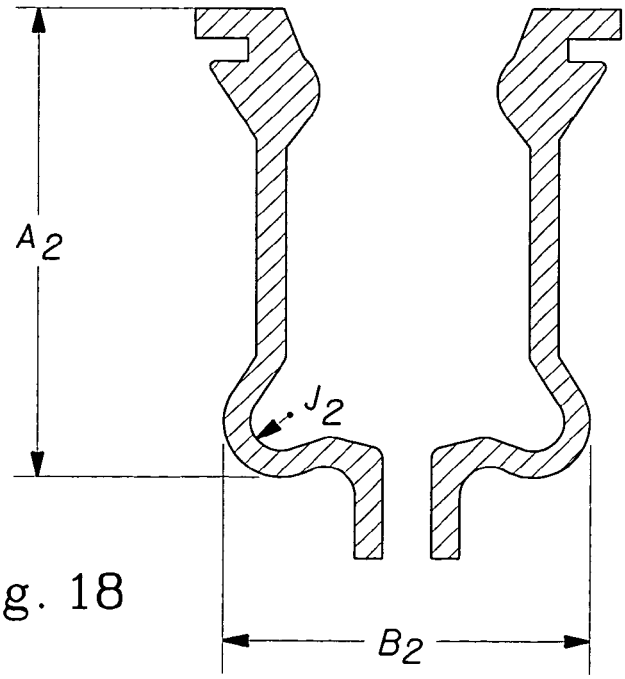
Figure 19:
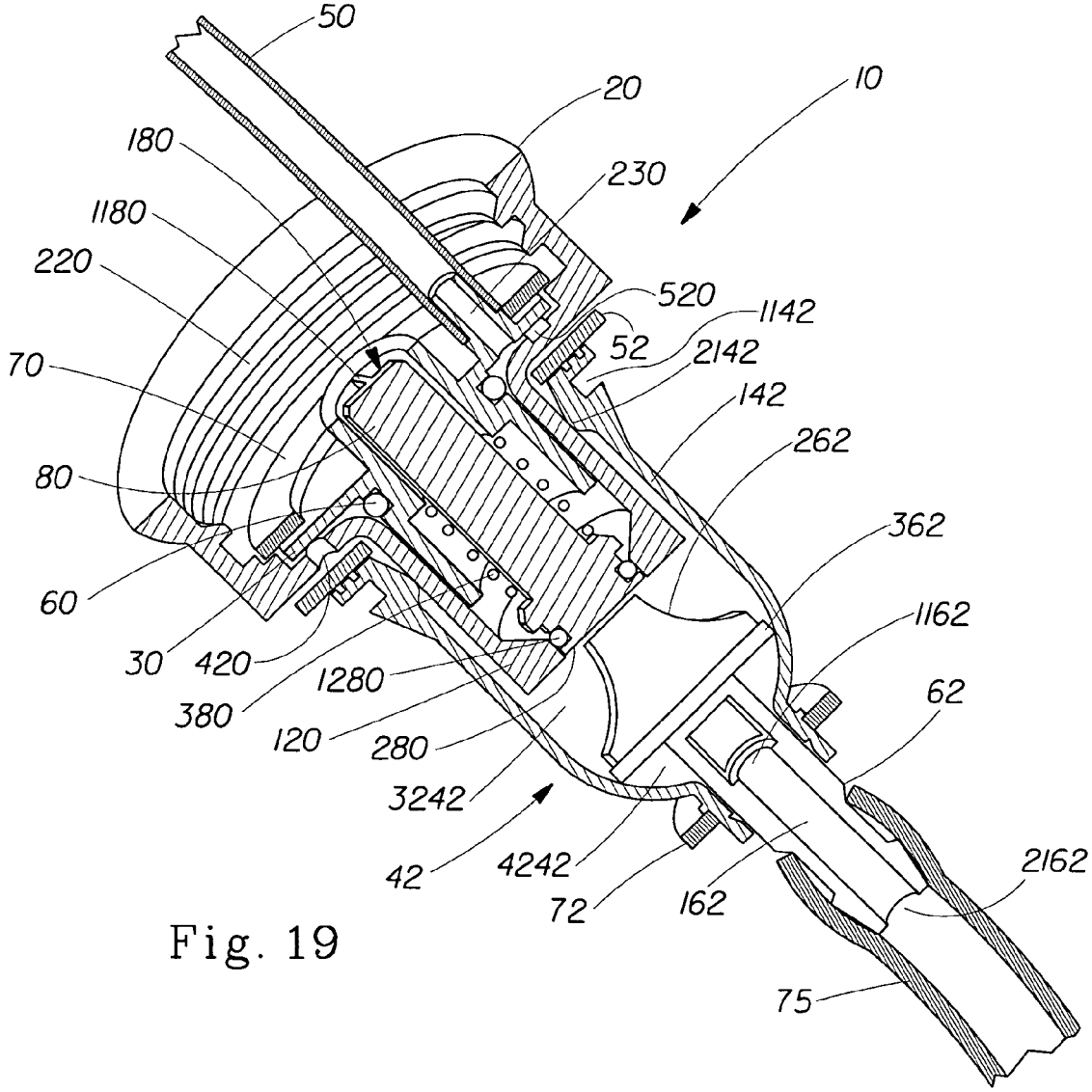
FIG. 19 is a partially cut-out isometric view of the fitment shown in FIG. 1 and the fluid delivery mechanism shown in FIG. 15 shown in a closed position.
Figure 20:
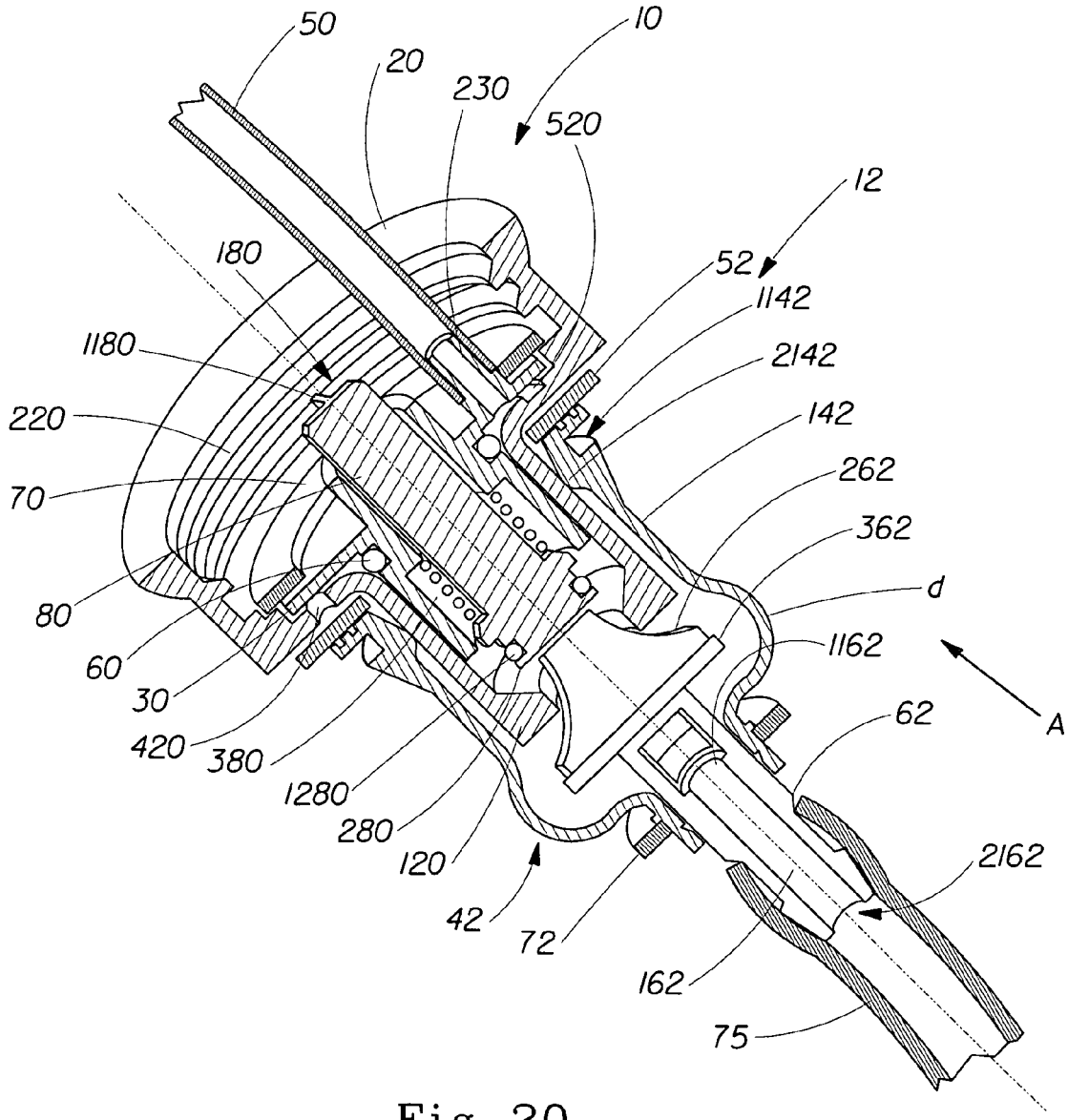
FIG. 20 is a partially cut-out isometric view of the embodiment of FIG. 19 shown in a opened position.

In one embodiment represented in FIGS. 14–16, the fluid delivery mechanism 12 comprises a receiving member 42 for receiving the engaging segment 120 of the fluid delivery fitment 10. The receiving member 42 comprises a wall 142 defining a chamber 242 for conveying a fluid from the engaging segment 120 of the fitment to the tube 75 in a substantially leak tight manner. The receiving member 42 comprises an upper inlet 1242 and a lower outlet 2242. In one embodiment, the receiving member 42 can have a substantially cup shape. In one embodiment, the engaging member 42 is made of a material which is substantially deformable and optionally but preferably elastic, i.e. which can be deformed when pressure is applied but returns to is original shape when pressure ceases to be applied against the receiving member 42. Non-limiting examples of suitable materials having appropriate deformability, elasticity and recovery properties include natural and synthetic rubbers, elastomeric materials and silicone type materials. In a preferred embodiment, the receiving member is made of silicone having a hardness or durometry between about 40 degrees Shore A and 90 degrees Shore A, preferably comprised between about 60 degrees Shore A and 80 degrees Shore A. A suitable receiving member is made of is made by Hayco Manufacturing Ltd company located in Hong Kong. In one embodiment, the upper portion of the receiving member 42 can be connected to the bottom surface 595 of the docking member 95. In a preferred embodiment, the upper portion of the receiving member 42 comprises a substantially circular channel 1142 such that an annular portion, which is adjacent to the lower opening 1595 of the bottom surface 595 of the docking member 95, engages the upper portion of the receiving member 42 within the channel 1142. In one embodiment, the engaging segment 120 of the fitment 10 can be inserted within the chamber 242 of the receiving member through the upper inlet 1242 in a substantially leak-tight manner. In a preferred embodiment, the receiving member 42 comprises a substantially circular "lip" 2142, shown in FIGS. 15–20, extending outwardly from the inner surface of the receiving member 42 such that the diameter at the tip of the "lip" 2142 is slightly smaller than the diameter of the engaging member 120. Among other benefits, the "lip" 2142 improves the leak-tightness of the connection between the engaging segment 120 and the receiving member 42 when the engaging segment 120 is inserted within the receiving member 42. When a user inserts the reservoir 55 with the fitment 10 and therefore the engaging segment 120 within the chamber 242 of the receiving member 42, the engaging segment 120 can potentially detach a portion if not all of the receiving member 42 from the bottom surface 595 of the docking member 95 if the engaging segment is not properly aligned with the receiving member 42. In a preferred embodiment, a protecting member 52 (shown in FIGS. 12 and 17) is disposed on the top of the receiving member 42. The protecting member 52 can have a substantially annular shape and can be sized such that the outer rim of the receiving member 42 is "covered" by the protecting member 52. The protecting member 52 minimizes the risk that the receiving member 42 is detached from the docking member 95 when the engaging segment 120 of the fitment 10 is inserted within the receiving member 42. In one embodiment, when the receiving member is in a relaxed state as shown in FIG. 17, the receiving member has a height A1 comprised between about 10 mm and about 100 mm, a lower outer diameter B1 comprised between about 10 mm and about 50 mm, an outlet diameter C comprised between about 1 mm and about 20 mm, a top connecting diameter D comprised between about 10 mm and about mm, an inner top diameter E comprised between about 6 mm and about 66 mm, an inner "lip" diameter F comprised between about 5 mm and about 64 mm, a connecting thickness G comprised between about 0.5 mm and about 5 mm, an inner chamber diameter H comprised between about 5 mm and about 49 mm, a body thickness I comprised between about 0.5 mm and about 5 mm, and a lower radius J1 comprised between about 2 mm and 40 mm. In one embodiment, when the receiving member is in a compressed state as shown in FIG. 18, the receiving member has a height A2 comprised between about 50% and 99% of the height A1, a lower outer diameter B2 comprised between about 101% and about 150% of the lower outer diameter B1, and a lower radius J2 comprised between about 30% and about 99% of the lower radius J1.

In one embodiment, the fluid delivery mechanism 12 comprises a transition member 62 for conveying a fluid from the receiving member 42 to the tube 75 in a substantially leak-tight manner. The transition member 62 comprises a hollow body 162 (shown in FIGS. 19 and 18) having at east one upper opening 1162 in fluid communication with a lower opening 2162. In one embodiment, the upper opening 1162 can be located in the upper portion of the transition member 62 and the lower opening 2162 can be located in the lower portion of the transition member 62. In a preferred embodiment, the upper portion of the transition member 62 is located within the receiving member 42 and the lower portion of the transition member 62 extends beyond the lower outlet 2242 of the receiving member 42 such that the lower portion of the receiving member 42 can be connected to the tube 75 in a substantially leak-tight manner. Among other benefits, the transition member 62 allows a liquid in the chamber 242 to flow through the upper opening 1162 of the transition member 62, within the transition member 62 and through the lower opening 2162, in a substantially leak-tight manner. In a preferred embodiment, a clipping member 72 is attached, preferably forceably attached to the lower portion of the receiving member 42 such that a motion of the clipping member 72 in a substantially upward direction as represented by the arrow A of FIGS. 16 and 18, causes the transition member 62 to move in a substantially upward direction. In a preferred embodiment, the upper portion of the receiving member 42 is fixedly attached to the bottom surface 595 of the docking member 95 such that an upper motion of the clipping member 72 causes the receiving member 42 to be deformed as represented by the deformation d shown in FIGS. 16 and 18. Among other benefits, the clipping member 72 improves the leak-tightness of the connection between the lower portion of the receiving member 42 and the transition member 62. In addition, the clipping member 72 provides a greater contact surface allowing the ear portions 1322, 1422 of the lever member 22 to "lift" in an upward direction the transition member 62.

In one embodiment, the transition member 62 comprises means 262 for actuating for actuating the check valve 80 of the fitment 10. The actuating means 262 can be any device suitable for movably engaging the check valve 80. Non-limiting example of means 262 for actuating the check valve 80 can be rod, pole, shaft, which can be hollow, tubular and/or solid and which allow a fluid to flow within and/or along the means for actuating the check valve 80 when this actuating means engages the check valve 80. In a preferred embodiment, the actuating means is an actuating rod which has a substantially cross shape at a cross-sectional. The actuating rod 262 is preferably connected to the upper portion of the transition member 62. When a user controllably causes the longitudinal member 32 to impart a pulling motion to the lever member 22, the ear portions 1322 and 1422, push the clipping member 72 in a substantially upward direction. The upward motion of the clipping member 72 causes the transition member 62 and the actuating rod 262 to move in a substantially upward direction concurrently. As the actuating rod 262 moves in the substantially upward direction, the actuating rod 262 pushes the piston portion 280 upwards such that the lower opening 220 of the engaging segment 120 ceases to be sealed causing the fluid contained in the reservoir 55 to flow by gravity from the reservoir 55 and the fitment 10, into the chamber 242, from the chamber 242 into the tube 75 via the transition member 62, from the tube 75 to the nozzle 225 and from the nozzle 225 to a surface to be cleaned. One skilled in the art will understand that the fluid in the reservoir 55 keeps flowing to the nozzle 225 as long as the actuating rod 262 actuates the check valve 80, i.e. as long as the longitudinal member 32 maintains the lever member 22 in an upward position. When the user allows the longitudinal member 32 to return to its original position, the lever member 22 can pivot back to a downward position causing the clipping member 72, the transition member 62 and, as a result, the actuating rod 262 to return concurrently to their original downward position as shown in FIGS. 15 and 17, and the biasing action of the spring member 380 causes the piston portion 280 to seal the lower opening 220 of the fitment 10 which, in turn, prevents the fluid from flowing to the nozzle 225. One skilled in the art will understand that depending on the elastic and/or recovery properties of the flexible receiving member, the receiving member 42 returns to its original position when pressure ceases to be applied on the clipping member 72. In another embodiment, the receiving member 42 can be such that the elastic and/or recovery properties of the receiving member do not allow the receiving member 42 to return to its original shape on its own when pressure ceases to be applied on the clipping member 72. In this embodiment, it can be preferred to add an additional spring member which can be connected at one end to the housing 45 or docking member 95 and at the other end to the receiving member 42 either directly or indirectly via the clipping member 72. The actuating rod 262 can have any shape suitable for actuating the check valve 80. In one embodiment, the actuating rod 262 can have a substantially cross shape and a height comprised between about 1 mm and 40 mm, preferably comprised between about 2 mm and 20 mm. In one embodiment, the distance between the check valve 80 and the actuating rod 262 is comprised between about 0 mm and about 10 mm, preferably between about 1 mm and about 5 mm. Among other benefits, a "gap" between the actuating rod 262 and the check valve 80 minimizes the risk that the check valve is accidentally actuated by the actuating rod 262 when a user inserts the reservoir 55 within the housing 45.

Optionally but preferably, the transition member 62 comprises a disk portion 362 for sealing the lower portion of the chamber 242 of the receiving member 42 in a substantially leak-tight manner.

One skilled in the art will understand that when a user actuates the previously described fluid delivery mechanism 12 while a fluid filled reservoir and a fitment 10 are inserted within the housing 45, the fluid flows by gravity to the nozzle 225. When the user ceases to actuate the fluid delivery mechanism 12, a column of fluid is "trapped" within the receiving member 42 and the tube 75 due to the leak-tightness between the check valve 80 and the lower opening 220 of the engaging segment 120 as well as the leak-tightness between the engaging segment 120 and the receiving member 42. In the event a user wishes to remove the reservoir from the housing 45 before the reservoir has been emptied, this leak-tightness to the outside atmosphere ceases and the column of fluid undesirably flows onto the floor surface. This situation may happen when for example the user wishes to use a different type of fluid contained in a different reservoir or wishes to disassemble the cleaning implement to decrease its storage space. As a result, it is believed that it can be useful to add stoppage means from preventing this column of fluid to flow undesirably onto a surface when the reservoir is removed. In one embodiment, the stoppage means can be a disk portion 362 which can be connected to the transition member 62 such that it is located between the actuating rod 262 and the upper opening 1162 of the transition member 62. In a preferred embodiment, the diameter of the disk portion 362 is slightly greater than the diameter of the portion of the receiving member 42 which is adjacent to the disk portion 362 such that the disk portion 362 contacts the inner surface of the receiving member in a substantially leak-tight manner. The disk portion 362 separates an upper portion 3242 of the chamber 242 of the receiving member 42 from the lower portion 4242 of the chamber 242 in a substantially leak-tight manner as shown in FIGS. 15 and 17. When a user actuates the liquid delivery mechanism 12, the deformation d of the receiving member as shown in FIGS. 16 and 18, allows the fluid to flow by gravity around the disk portion 362 of the transition member 62. When the user ceases to actuate the fluid delivery mechanism 12, the receiving member 42 returns to its original shape as shown in FIGS. 15 and 17, and the disk portion sealably contacts the inner surface of the receiving member 42 causing the upper portion 3242 of the chamber 242 to be sealingly separated from the lower portion 4242 of the chamber 242. One skilled in the art will understand that if a user wishes to remove the reservoir 55 from the housing 45, the column of fluid contained within the lower portion 4242 of the chamber 242 and the tube 75 is "trapped" and does not flow unwontedly onto the floor. Without intending to be bound by any theory, it is believed that when the receiving member 42 is compressed, it deforms substantially outwardly as represented by element d of FIGS. 16 and 18 due to the thickness and the concavity of the receiving member 42. In addition, when the engaging segment is inserted within the receiving member, the substantially rigid wall of the engaging segment causes the receiving member to deform outwardly rather than inwardly. In one embodiment, weaknesses can be added to the receiving member 42 in order to assure its outward deformation. In one embodiment, these weaknesses can be in the form of a groove or channel.

While particular embodiments of the subject invention have been described, it will be apparent to those skilled in the art that various changes and modifications of the subject invention can be made without departing from the spirit and scope of the invention. In addition, while the present invention has been described in connection with certain specific embodiments thereof, it is to be understood that this is by way of limitation and the scope of the invention is defined by the appended claims which should be construed as broadly as the prior art will permit.

What is claimed is:

1. A fluid transfer fitment, said fitment comprising:

a cap portion having a first fluid transfer opening;

an engaging segment for engaging a receiving member of a fluid delivery mechanism, wherein said engaging segment extends from said first fluid transfer opening of said cap portion and wherein said engaging segment comprises a wall defining a cavity and a second fluid transfer opening in fluid communication with said first fluid transfer opening; and a fluid transfer check valve for controllably preventing a fluid from flowing through said fitment, wherein said fluid transfer check valve is connected to said engaging segment and wherein at least a portion of said fluid transfer check valve is located within said engaging segment; said fitment comprising a fluid filled reservoir having substantially rigid walls and having a finish portion wherein said cap portion is releasably attached to said finish portion and wherein said fluid filled reservoir is inverted;

wherein said cap portion comprises a vent opening in fluid communication with the outside atmosphere and a vent valve in fluid communication with said vent opening; wherein said fluid transfer check valve controllably closes said first fluid transfer opening in a substantially leak-tight manner;

and wherein said fluid transfer check valve controllably closes said second fluid transfer opening in a substantially leak-tight manner.

* * * * *